US010266304B2

(12) United States Patent
Smith et al.

(10) Patent No.: US 10,266,304 B2
(45) Date of Patent: Apr. 23, 2019

(54) STACKABLE PACKAGING UNITS AND METHODS FOR MANUFACTURING THE SAME

(71) Applicants: Chad Smith, Soquel, CA (US); Randall Strange, Manteca, CA (US)

(72) Inventors: Chad Smith, Soquel, CA (US); Randall Strange, Manteca, CA (US)

(73) Assignee: Chad Smith, Petaluma, CA (US)

( * ) Notice: Subject to any disclaimer, the term of this patent is extended or adjusted under 35 U.S.C. 154(b) by 154 days.

(21) Appl. No.: 15/238,297

(22) Filed: Aug. 16, 2016

(65) Prior Publication Data

US 2017/0369202 A1 Dec. 28, 2017

Related U.S. Application Data

(60) Provisional application No. 62/353,814, filed on Jun. 23, 2016.

(51) Int. Cl.
*B65D 1/36* (2006.01)
*B65D 8/00* (2006.01)
(Continued)

(52) U.S. Cl.
CPC ..... *B65D 21/0217* (2013.01); *B31B 50/00* (2017.08); *B31B 50/59* (2017.08);
(Continued)

(58) Field of Classification Search
CPC ..... B65D 21/0209; B65D 21/0217; B65D 21/0223; B65D 21/022; B65D 1/36;
(Continued)

(56) References Cited

U.S. PATENT DOCUMENTS 1,707,528 A * 4/1929 La Bombard ..... B65D 5/4287 229/105
3,372,856 A 3/1968 Erhart et al.
(Continued)

FOREIGN PATENT DOCUMENTS

EP 0087306 A2 8/1983
EP 0169737 A2 1/1986
(Continued)

*Primary Examiner* — Fenn C Mathew
*Assistant Examiner* — Jennifer Castriotta
(74) *Attorney, Agent, or Firm* — Vierra Magen Marcus LLP

(57) ABSTRACT

A stackable packaging unit comprises a molded tray including one or more compartments and a female feature. Additionally, the stackable packaging unit includes a cover attached to the molded tray and configured to cover at least a portion of at least one of the compartment(s) of the molded tray. The cover is made of folded paperboard or cardboard and includes a handle extending upward. The handle of the cover provides a male feature that is configured to fit within the female feature of a further one of the stackable packaging units that's stacked above the stackable packaging unit. The molded tray can be made of molded pulp, in which case the molded tray and the paperboard or cardboard from which the cover is made can both be recyclable. The molded tray and the paperboard or cardboard from which the cover is made can additionally or alternatively include postconsumer recycled material.

19 Claims, 21 Drawing Sheets

(51) Int. Cl.

| | |
|---|---|
| ***B65D 21/02*** | (2006.01) |
| ***B65D 25/28*** | (2006.01) |
| ***B65D 71/44*** | (2006.01) |
| ***B65D 71/52*** | (2006.01) |
| ***B65D 85/32*** | (2006.01) |
| ***B31B 50/00*** | (2017.01) |
| ***B31B 50/59*** | (2017.01) |
| *B31B 50/81* | (2017.01) |
| *B31B 105/00* | (2017.01) |
| *B31B 110/20* | (2017.01) |
| *B31B 120/10* | (2017.01) |

(52) U.S. Cl.
CPC ..... *B65D 1/36* (2013.01); *B65D 15/00* (2013.01); *B65D 21/0209* (2013.01); *B65D 21/0223* (2013.01); *B65D 25/28* (2013.01); *B65D 25/2867* (2013.01); *B65D 71/0003* (2013.01); *B65D 71/44* (2013.01); *B31B 50/81* (2017.08); *B31B 2105/00* (2017.08); *B31B 2110/20* (2017.08); *B31B 2120/10* (2017.08); *B65D 85/32* (2013.01); *B65D 2501/24617* (2013.01); *B65D 2501/24636* (2013.01); *B65D 2501/24643* (2013.01)

(58) Field of Classification Search
CPC .. B65D 71/0003; B65D 85/32; B65D 85/321; B65D 85/322; B65D 85/324; B65D 85/325; B65D 85/327; B65D 85/328; B65D 25/2867; B65D 2501/24617; B65D 2501/2501; B65D 2501/2463; B65D 2501/24636; B65D 2501/24643; B65D 2501/24859
See application file for complete search history.

(56) References Cited

U.S. PATENT DOCUMENTS

| | | | | |
|---|---|---|---|---|
| 3,836,067 | A | 9/1974 | Andersson | |
| 4,603,809 | A | 8/1986 | Vilotte et al. | |
| 7,258,234 | B2 | 8/2007 | Aardema et al. | |
| 2015/0291346 | A1 | 10/2015 | Rosenkrantz-Theil | |
| 2015/0329277 | A1 | 11/2015 | Dijkstra | |
| 2017/0305596 | A1* | 10/2017 | Dag ..... | B65D 5/38 |

FOREIGN PATENT DOCUMENTS

| | | | |
|---|---|---|---|
| EP | 0359613 | A1 | 3/1990 |
| WO | WO 96/38355 | A1 | 12/1996 |
| WO | WO 03/068633 | A1 | 8/2003 |
| WO | WO 2013/116387 | A2 | 8/2013 |

* cited by examiner

STACKABLE PACKAGING UNITS AND METHODS FOR MANUFACTURING THE SAME

PRIORITY CLAIM

The present application claims priority to U.S. Provisional Patent Application No. 62/353,814, filed Jun. 23, 2016, which is incorporated herein by reference.

BACKGROUND

Products such as produce (which products can also be referred to more generically as items) are often shipped to stores in cardboard boxes that each hold a plurality of products loosely within the box. Sometimes layers of the produce or other items are separated from one another within a box (which can also be referred to as a shipping carton) by molded pulp or other cushioning structures which may, or may not, include cavities that separate individual (or groups of) items from one another. When shipped in this matter, the items are typically removed from the box by hand and placed on tables, shelves or other types of display platforms in stores. This is both labor intensive and time consuming, which are undesirable and costly. Further, when the items are manually unpacked from the boxes, people's hands, which may not be sanitary, may come into direct physical contact with the items, which is also undesirable. Additionally, if molded pulp cushioning structures are included in a box of items, the molded pulp cushioning structures are typically discarded once the items within the box have been removed from the box, which is wasteful. Additionally, if items are manually unpacked from a box, the additional handling of the items may cause bruising that makes the items less attractive to consumers, and may result in those items not being sold, resulting in product loss and waste, which is undesirable.

SUMMARY

Certain embodiments of the present technology are directed to a stackable packaging unit that comprises a molded tray including one or more compartments and a female feature. Additionally, the stackable packaging unit includes a cover attached to the molded tray and configured to cover at least a portion of at least one of the one or more compartments of the molded tray, wherein the cover is made of folded paperboard or cardboard and includes a handle extending upward, and wherein the handle of the cover provides a male feature that is configured to fit within the female feature of a further one of the stackable packaging units that is stacked above the stackable packaging unit.

In accordance with certain embodiments, the male feature provided by the handle, when fit within the female feature of a further one of the stackable packaging units that is stacked above the stackable packaging unit, inhibits the further one of the stackable packaging units from sliding horizontally to-and-fro and side-to-side relative to the cover upon which the further one of the stackable packaging units rests. In accordance with certain embodiments, the male feature provided by the handle, when fit within the female feature of a further one of the stackable packaging units that is stacked above the stackable packaging unit, allows the further one of the stackable packaging units to be lifted up vertically relative to the cover upon which the further one of the stackable packaging units rests.

In accordance with certain embodiments, the female feature included in the molded tray includes one or more protrusions and/or indentations, and the male feature provided by the handle includes one or more indentations and/or protrusions that are configured that mate with respective protrusions and/or indentations within the female feature of a further one of the stackable packaging units that is stacked above the stackable packaging unit.

In accordance with certain embodiments, the cover includes a horizontal planar portion, the handle of the cover extends upward relative to the horizontal planar portion of the cover, and the horizontal planar portion of the cover provides a horizontal surface on which to rest the molded tray of a further one of the stackable packaging units that is stacked above the stackable packaging unit.

In accordance with certain embodiments, the molded tray also includes one or more support columns extending upward, and one or more regions of the horizontal planar portion of the cover rest on and are supported by the one or more support columns of the molded tray. In some such embodiments, the one or more support columns of the molded tray are configured to prevent the horizontal planar portion of the cover from collapsing under the weight of a further one of the stackable packaging units that is stacked above the stackable packaging unit and thereby resting on the horizontal planar portion.

In accordance with certain embodiments, the cover also includes two or more or attachment arms that extend downward from the horizontal planar portion of the cover, wherein the attachment arms are for use in attaching the cover to the molded tray. In some such embodiments, all of the portions of the cover, including the horizontal planar portion, the handle and the attachment arms, are made from a single sheet of the paperboard or cardboard that is cut and folded to provide said portions of the cover.

In accordance with certain embodiments, distal portions of one or more of the cover attachment arms are attached to the molded tray by an adhesive. Alternatively, or additionally, a distal portion of each of one or more of the cover attachment arms includes one or more tabs that extend outward. In such embodiments, the distal portion of each of the one or more of the cover attachment arms is inserted through a respective slot in the molded tray, and the one or more tabs that extend outward from the distal portion of each of the one or more of the cover attachment arms prevents the cover attachment arm from being inadvertently detached from the molded tray.

In accordance with certain embodiments, the molded tray is made of molded pulp. In some such embodiments, the molded pulp from which the molded tray is made and the paperboard or cardboard from which the cover is made are both recyclable. In some embodiments, the molded pulp from which the molded tray is made and the paperboard or cardboard from which the cover is made both include postconsumer recycled material.

In accordance with certain embodiments, a stackable packaging unit comprises a molded pulp tray including two or more compartments and a female feature located between two of the compartments. Alternatively, the molded tray can be molded from plastic. In some embodiments, the molded tray includes only a single compartment.

In accordance with certain embodiments, the stackable packaging unit includes a cover attached to the molded tray and including a horizontal planar portion and handle extending upward therefrom, wherein all of the portions of the cover, including the horizontal planar portion and the handle, are made from a single sheet of the paperboard or cardboard that is cut and folded to provide said portions of the cover. In some such embodiments, the handle of the cover provides a male feature that is configured to: fit within the female feature of a further one of the stackable packaging units that is stacked above the stackable packaging unit; inhibit the further one of the stackable packaging units from sliding horizontally to-and-fro and side-to-side relative to the cover; and allows the further one of the stackable packaging units to be lifted up vertically relative to the cover.

In accordance with certain embodiments, the cover is configured to allow products stored within the compartment(s) to be at least partially visible. In accordance with certain embodiments, at least a portion of the horizontal planar portion of the cover is printed on or includes a label adhered thereto.

Certain embodiments of the present technology are related to methods for manufacturing a stackable packaging unit. In accordance with certain such embodiments, a method comprises: molding a tray that includes one or more compartments and a female feature; cutting a sheet of paperboard or cardboard in accordance with a pattern to provide a paperboard or cardboard blank; folding the blank of paperboard or cardboard to make a cover (that includes a horizontal planar portion, a handle that extends upward from the horizontal planar portion and provides a male feature, and at least two cover attachment arms); and attaching the cover attachment arms (of the cover made from the paperboard or cardboard) to the molded tray.

In accordance with certain embodiments, the molding step comprises molding the tray from pulp to produce a molded pulp tray. Alternatively, the molding step can comprise molding the tray from plastic.

In accordance with certain embodiments, the attaching step includes attaching distal portions of one or more of the cover attachment arms to the molded tray using an adhesive. Alternatively, or additionally, the attaching step can include folding in one or more tabs that extend outward from a distal portion of one or more of the cover attachment arms, inserting the distal portion of one or more of the cover attachment arms into a respective slot in the molded tray, and at least partially unfolding the one or more tabs that extend outward from the distal portion of one or more of the cover attachment arms so that the unfolded tab(s) prevent the distal portion of the one or more cover attachment arms from sliding out of its respective slot in the molded tray.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 10 is a cross section of the stackable packaging unit introduced in FIG. 1A along the line C-C in FIG. 1A.

DETAILED DESCRIPTION

Figure 1A:
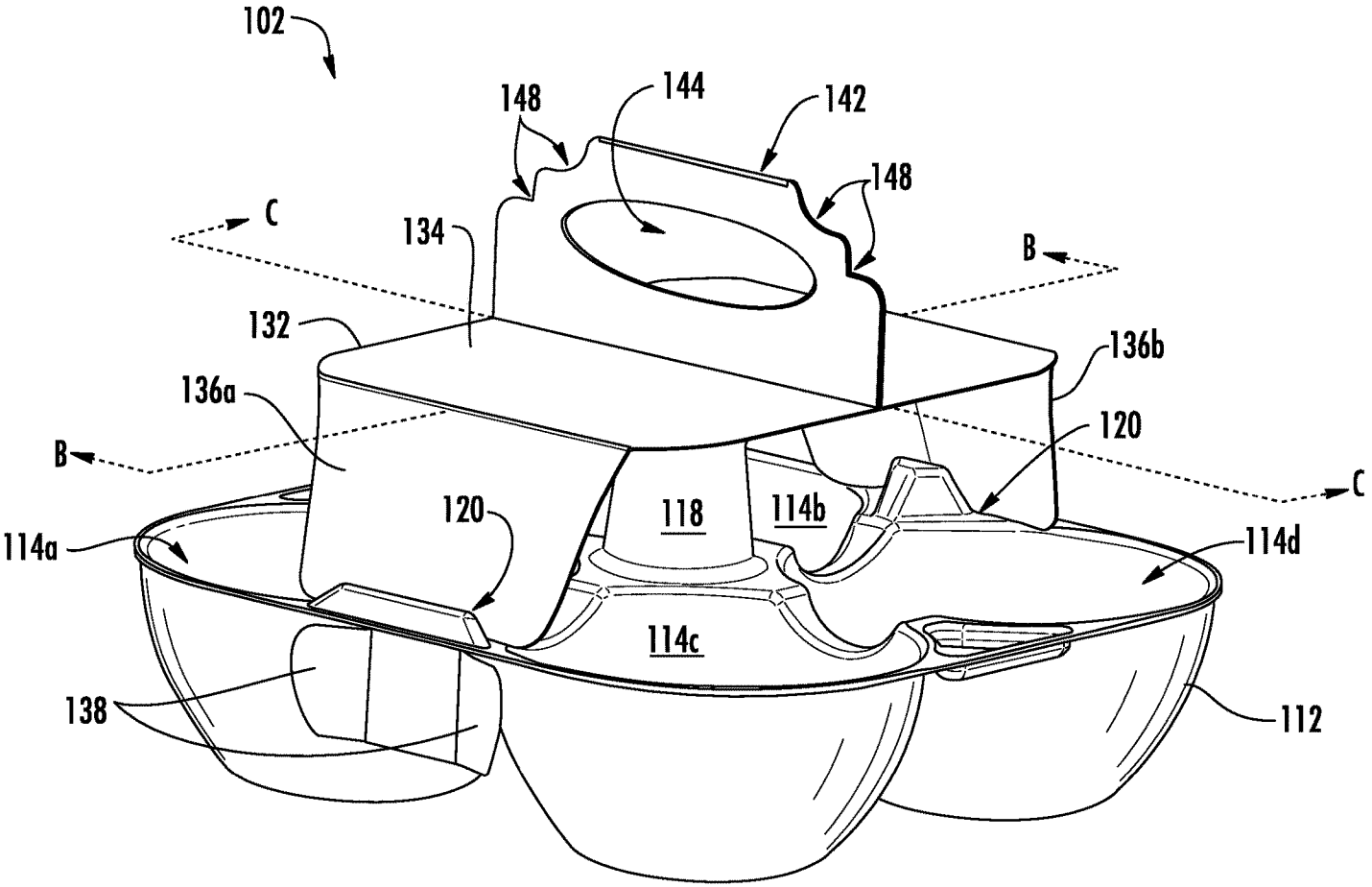
FIG. 1A is a perspective view of the stackable packaging unit, according to an embodiment of the present technology.
Figure 1B:
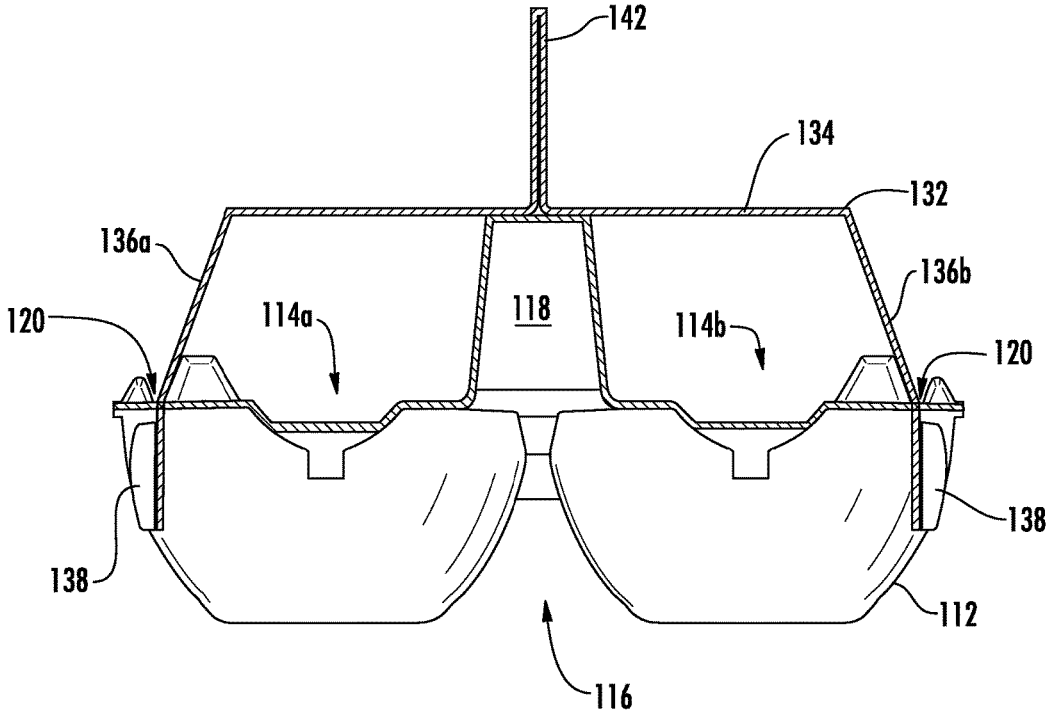
FIG. 1B is a cross section of the stackable packaging unit introduced in FIG. 1A along the line B-B in FIG. 1A.
Figure 1C:
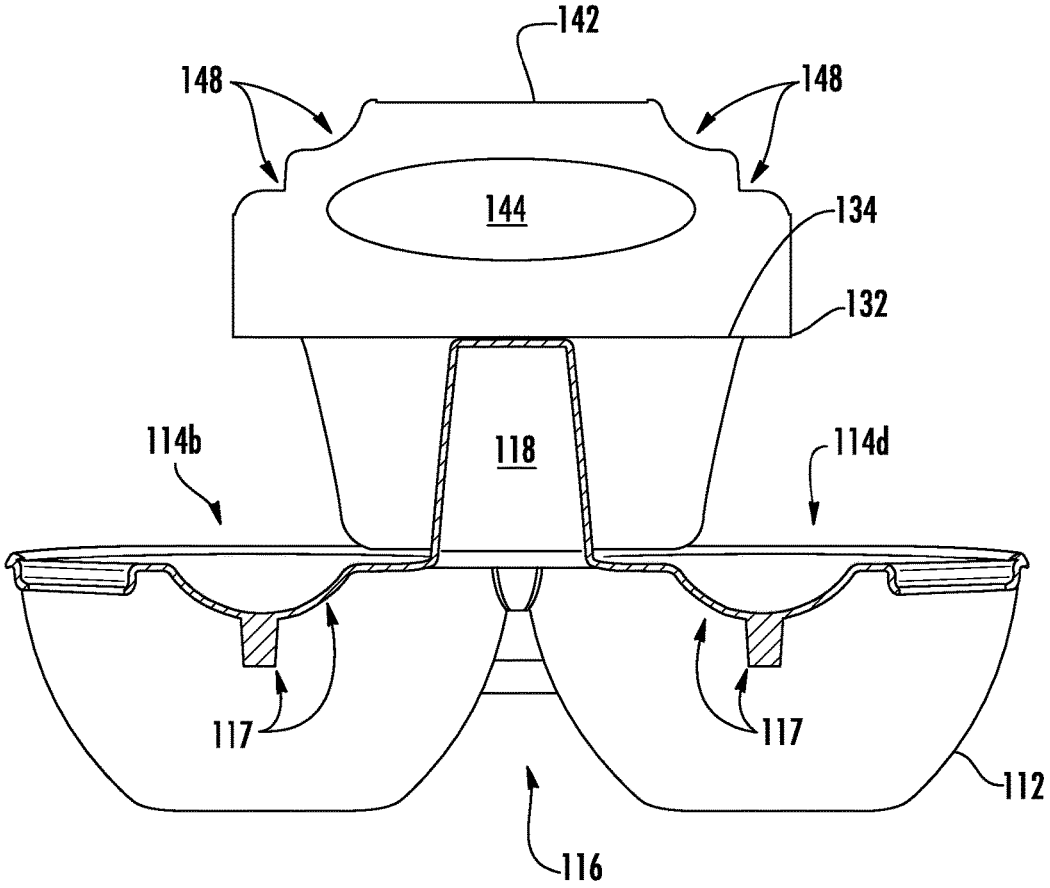
FIG. 1D is similar to FIG. 1B, in that it is a cross section of the stackable packaging unit along the line B-B in FIG. 1A, but shows how two of the stackable packaging units can be stacked one above the other.
FIG. 1E is similar to FIG. 10, in that it is a cross section of the stackable packaging unit along the line C-C in FIG. 1A, but shows how two of the stackable packaging units can be stacked one above the other.
FIG. 1F is an exploded perspective view of stackable packaging unit introduced in FIG. 1A.
FIG. 1G shows how the cover of the stackable packaging unit introduced in FIG. 1A can be produced from a single sheet of paperboard or cardboard.
FIG. 1H shows how an alternative cover of the stackable packaging unit introduced in FIG. 1A can be produced from a single sheet of paperboard or cardboard.
Figure 1D:
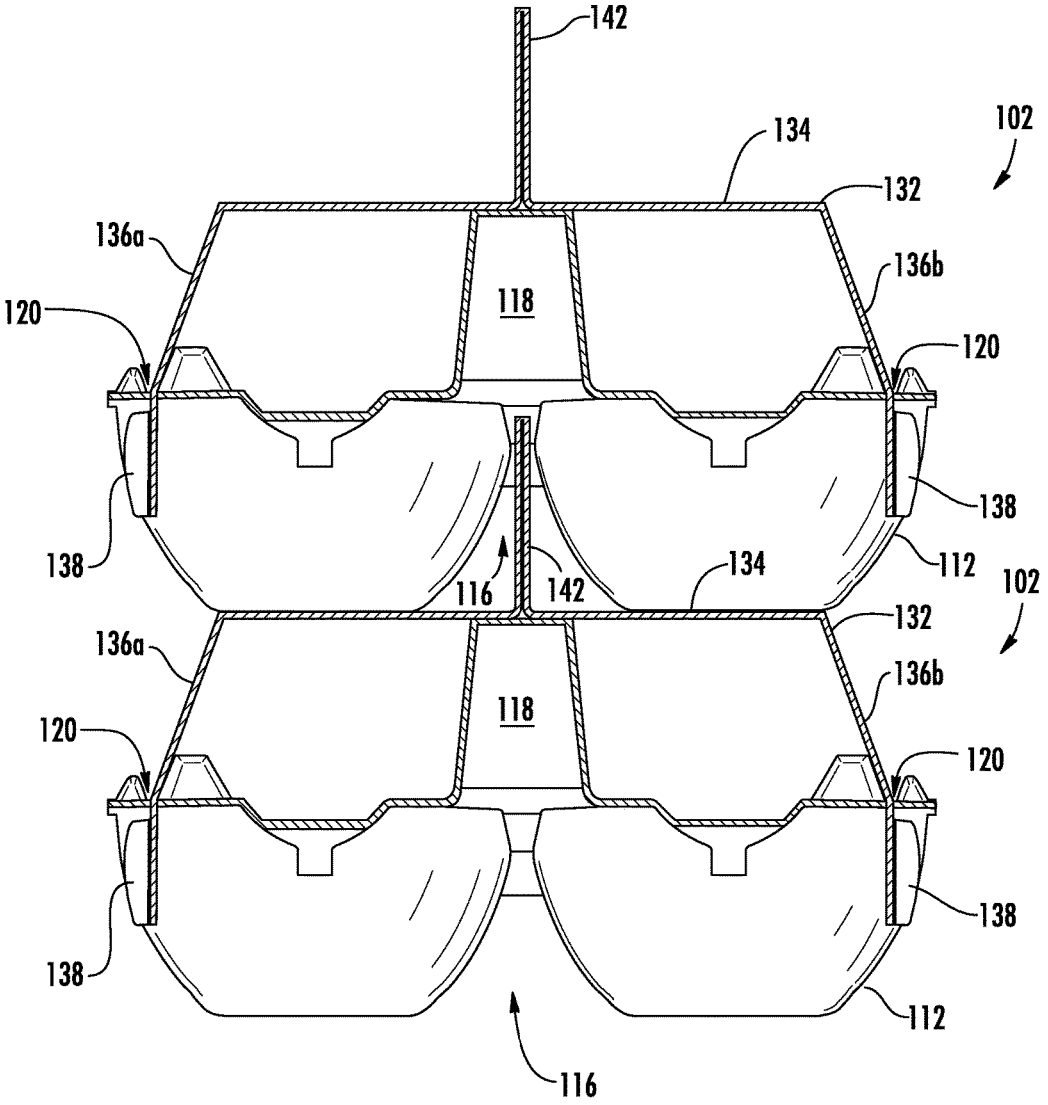
Figure 1E:
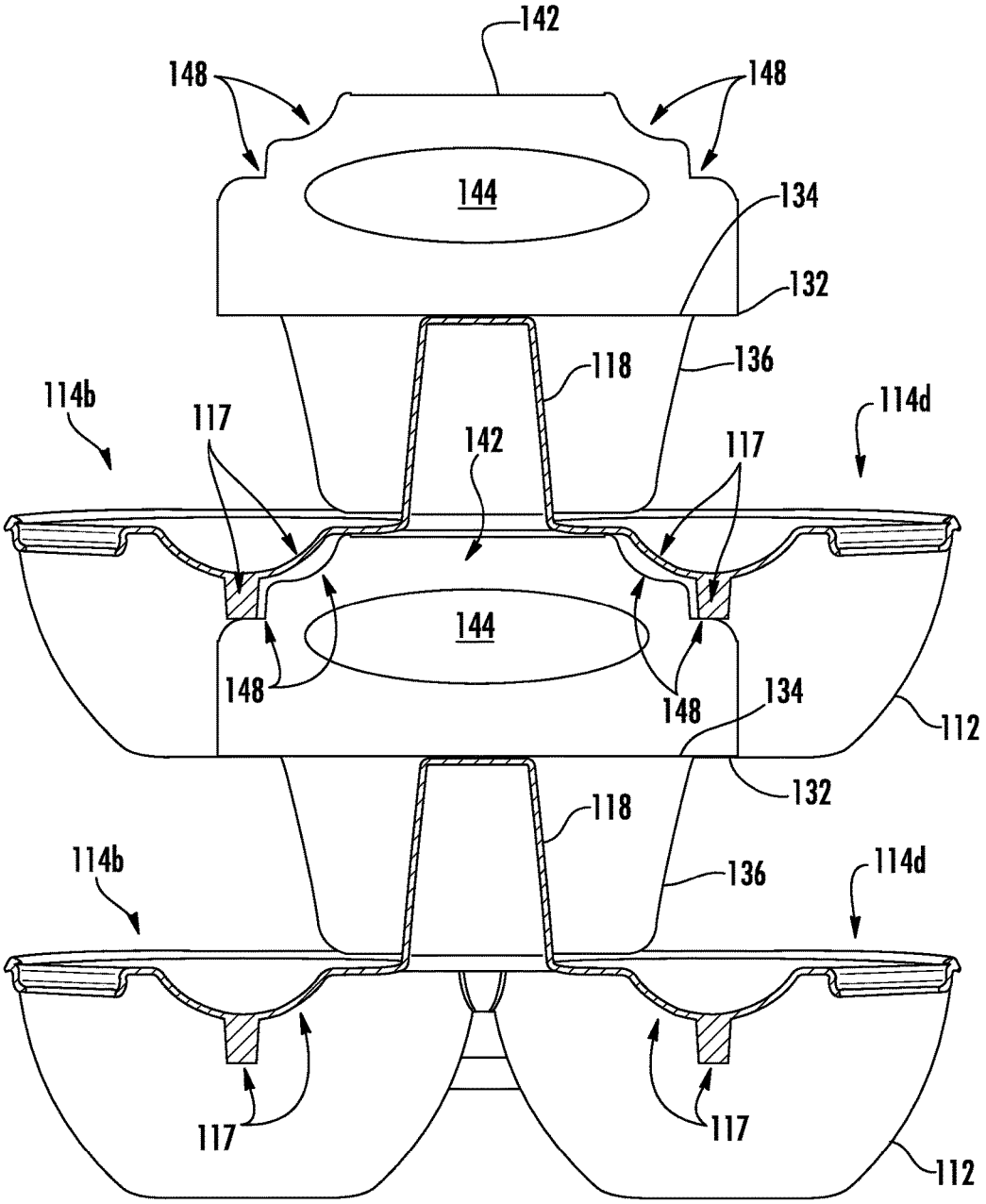
Figure 1F:
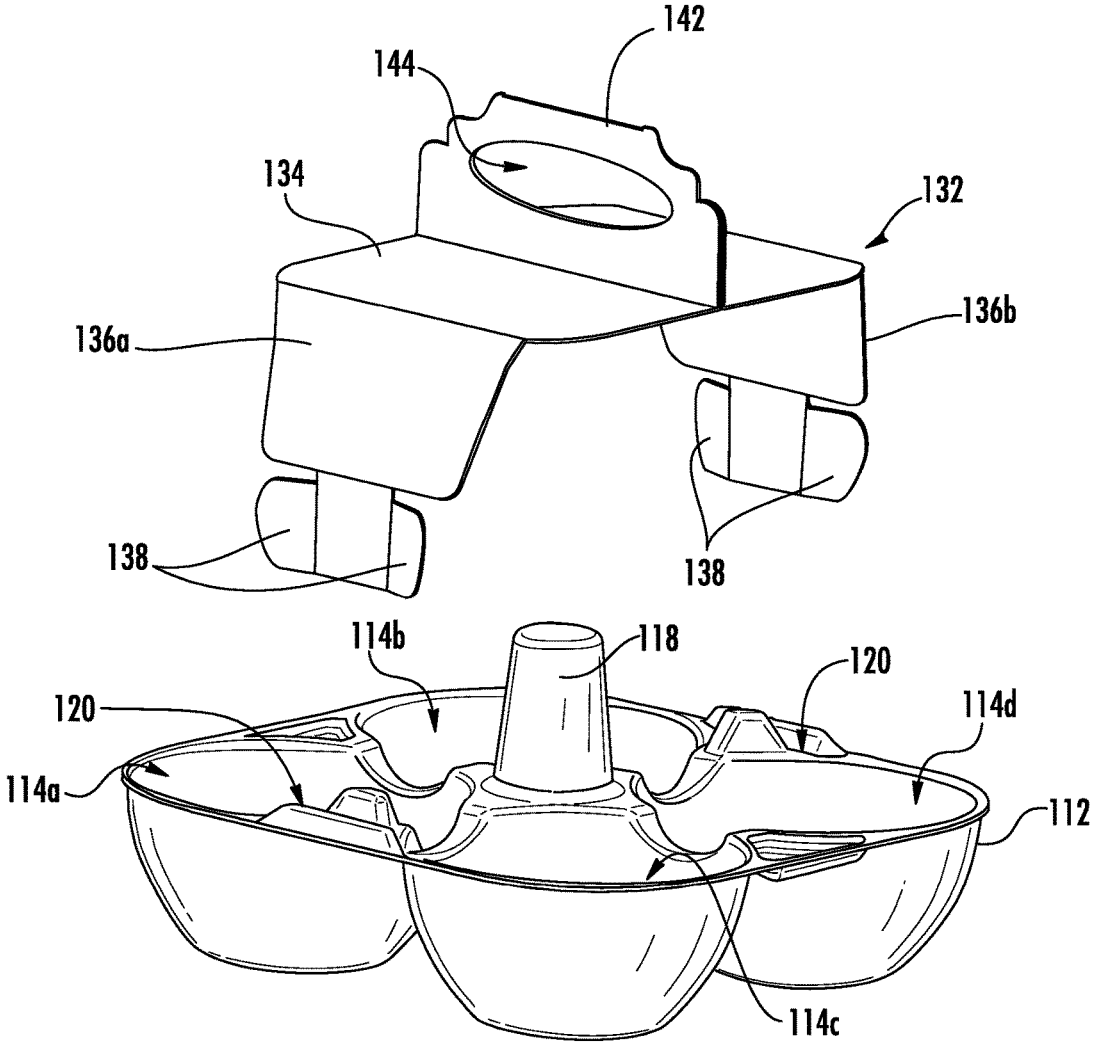
Figure 1G:
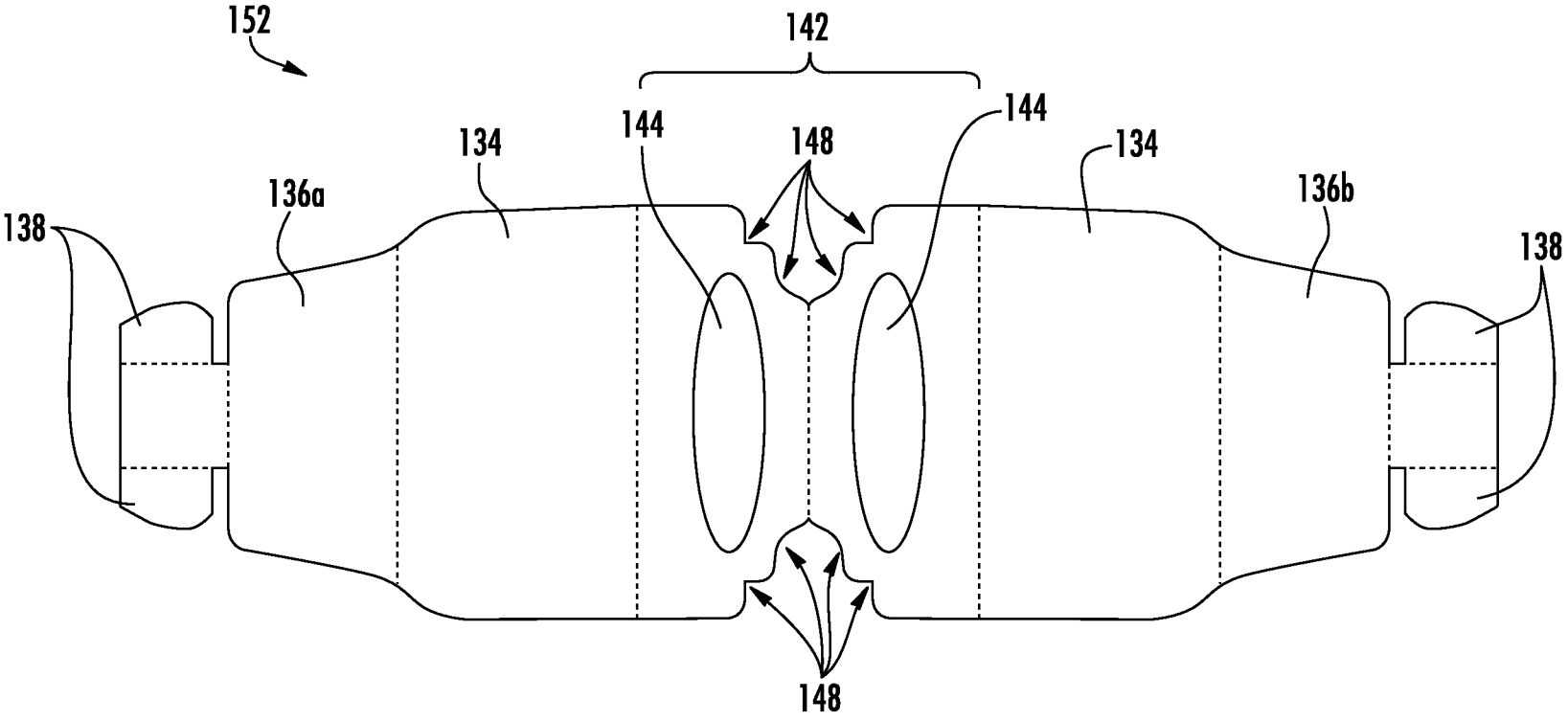

FIGS. 1A-1G will initially be used to describe a stackable packaging unit 102, according to an embodiment of the present technology. More specifically, FIG. 1A is a perspective view of the stackable packaging unit 102. FIG. 1B is a cross section of the stackable packaging unit 102 along the line B-B in FIG. 1A, and FIG. 10 is a cross section of the stackable packaging unit 102 along the line C-C in FIG. 1A. FIG. 1D is similar to FIG. 1B (in that it is a cross section of the stackable packaging unit 102 along the line B-B in FIG. 1A), but shows how two of the stackable packaging units 102 can be stacked one above the other. FIG. 1E is similar to FIG. 10 (in that it is a cross section of the stackable packaging unit 102 along the line C-C in FIG. 1A), but shows how two of the stackable packaging units 102 can be stacked one above the other. FIG. 1F is an exploded perspective view of stackable packaging unit 102. FIG. 1G shows how the cover 132 can be produced from a single sheet of paperboard or cardboard.

Referring to FIGS. 1A-1F, the stackable packaging unit 102 is shown as including a molded tray 112 having four compartments 114*a*, 114*b*, 114*c* and 114*d*. The compartments 114*a*, 114*b*, 114*c* and 114*d* can be individually referred to as a compartment 114, or collectively as the compartments 114. The compartments 114 can also be referred to as cells. Each of the compartments 114 can be used to hold and display an individual item, such as, a separate piece of fruit or a separate vegetable item. In certain embodiments, each of the compartments 114 may be sized to hold an egg. In other embodiments, each of the compartments 114 can be used to hold multiple items. It is also noted that the compartments 114 can hold non-produce and more generally, non-food products. For example, each of the compartments 114 may hold a piece of soap, a bath bomb (which is a hard-packed mixture of dry ingredients that effervesce when placed in a bathtub filled with water), a bottle, a jar, a mug, a bowl, an electrical device or an electromechanical device, just to name a few. These are just a few examples, which are not intended to be all encompassing. The specific shape, size and number of compartments can be customized for the type and quantity of items that the compartments are intended to hold.

As can be seen in FIGS. 1C-1E, the molded tray 112 also includes a female feature 116 that is useful when stacking multiple ones of the stackable packaging unit 102 one above the other, as best shown in FIGS. 1D and 1E. In this embodiment, the female feature 116 extends upwards between the bottoms of adjacent pairs of the compartments 114 of the molded tray 112. Additionally, the molded tray 112 includes a support column 118 extending upward. In accordance with alternative embodiments, some of which are described below, the molded tray of a stackable packaging unit can include more or less than four compartments. In specific embodiments, an example of which is described below with reference to FIGS. 3A-3G, a molded tray of a stackable packaging unit can include only a single compartment.

Still referring to FIGS. 1A-1F, the stackable packaging unit 102 is also shown as including a cover 132 that is made of folded paperboard or cardboard and is attached to the molded tray 112. The cover 132 is shown as covering a portion of each of the compartments 114, to thereby protect any items therein (if present), while still allowing the compartments 114 and any items therein (if present) to be at least partially visible. The cover 132, which as mentioned above is made of folded paperboard or cardboard, includes a handle 142 extending upward. The handle 142 of the cover 132 provides a male feature that is configured to fit within the female feature 116 of a further one of the stackable packaging units 102 that is stacked above the stackable packaging unit 102, as shown in FIG. 1E. In other words, the handle functions as both an element that a person can grasp or otherwise hold using their hands, and well as a male portion of a male and female connector pair arrangement. The paperboard or cardboard from which the cover 132 (including its handle 142) is made can be single-ply or multi-ply, and in the case of cardboard, can include a corrugated layer sandwiched between a pair of non-corrugated layers, each of which can be single-ply or multi-ply. The paperboard or cardboard from which the cover 132 is made can be partially or entirely made from postconsumer recycled material. Depending upon implementation, the paperboard or cardboard from which the cover 132 is made can itself be recyclable and/or compostable.

As mentioned above, the cover 132 is shown as covering a portion of each of the compartments 114, to thereby protect any items therein (if present), while still allowing the compartments 114 and any items therein (if present) to be at least partially visible. In other words, the cover 132 can including one or more openings or windows that enable item(s) within the stackable packaging unit 102 to be viewed. Such openings or windows may be sized to prevent shoppers from removing items from the stackable packaging unit 102 and handling and potentially damaging (e.g., bruising) the items, making them less saleable. More specifically, the openings or windows can be smaller than the item(s) within the stackable packaging unit 102. In such embodiments, the stackable packaging unit 102 can be configured such that a person needs to remove the cover 132, or at least detach a portion thereof from the molded tray 112, before being able to remove the item(s) from the stackable packaging unit 102. In alternative embodiments, the openings or windows can be larger than the items, and may be purposely designed to allow people to remove item(s) from the stackable packaging unit 102 without needing to first remove the cover 132.

In accordance with a preferred embodiment, the molded tray 112 is made from molded pulp, which is considered a sustainable packaging material. In alternative embodiments, the molded tray 112 can instead be molded from plastic, which may be clear or opaque, depending upon implementation. Exemplary details of how to produce the molded tray 112 are described below with reference to step 402 in FIG. 4.

Where the molded tray 112 is made from molded pulp and the cover 132 is made from paperboard or cardboard, the molded tray 112 and the cover 132, and thus the entire stackable packaging unit 102, can be recyclable and/or compostable. Further, where the molded tray 112 is made from molded pulp and the cover 132 is made from paperboard or cardboard, the molded tray 112 and the cover 132, and thus the entire stackable packaging unit 102, can include postconsumer recycled material, and can even be made of entirely of postconsumer recycled material.

Still referring to FIGS. 1A-1F, the cover 132 includes a horizontal planar portion 134, from which the handle 142 of the cover 132 extends upward. The horizontal planar portion 134 of the cover 132 provides a horizontal surface on which to rest the molded tray 112 of a further one of the stackable packaging units 102 that is stacked above the stackable packaging unit 102, as shown in FIGS. 1D and 1E. A region of the horizontal planar portion 134 of the cover 132 rests on and is supported by the support column 118 of the molded tray 112. In this manner, the support column 118 of the molded tray 112 prevents the horizontal planar portion 134 of the cover 132 from collapsing under the weight of a further one of the stackable packaging units 102 that is stacked above the stackable packaging unit 102 and is thereby resting on the horizontal planar portion 134.

The male feature provided by the handle 142, when fit within the female feature 116 of another stackable packaging unit 102 that is stacked above the stackable packaging unit 102, inhibits (and preferably prevents) the upper stackable packaging unit 102 from sliding horizontally to-and-fro and/or side-to-side relative to the cover 132 upon which the upper stackable packaging unit 102 rests, but allows the upper one of the stackable packaging units 102 to be lifted up vertically relative to the cover 132 upon which the upper stackable packaging unit 102 rests. Accordingly, a plurality of the stackable packaging units 102 are not only stackable, but are also nestable or interlocking.

In the embodiment shown in FIGS. 1A-1F, the female feature 116 included in the molded tray 112 includes protrusions 117, and the male feature provided by the handle 142 includes indentations 148 that are configured that mate with respective protrusions 117 of the female feature 116 of a further one of the stackable packaging units 102 that is stacked above the stackable packaging unit 102. In alternative embodiments, the female feature included in the molded tray includes indentations, and the male feature provided by the handle includes protrusions that are configured that mate with respective indentations of the female feature of a further one of the stackable packaging units that is stacked above the stackable packaging unit. More generally, the male feature provided by the handle can include one or more indentations and/or protrusions (or other profile shapes) that is/are configured to mate with respective protrusions and/or indentations (or other profile shapes) of the female feature of a further one of the stackable packaging units that is stacked above the stackable packaging unit.

In the embodiment shown in FIGS. 1A-1F, the cover 132 includes two attachment arms 136*a* and 136*b* that extend downward (albeit at an angle) from the horizontal planar portion 134 of the cover 132. The attachment arms 136*a* and 136*b*, which can be referred to collectively as the attachment arms 136, or individually as an attachment arm 136, are used to attach the cover 132 to the molded tray 112. As can be appreciated from FIG. 1F, all of the portions of the cover 132, including the horizontal planar portion 134, the handle 142 and the attachment arms 136, are made from a single sheet of the paperboard or cardboard that is cut and folded to provide such portions of the cover 132. In the embodiment shown in FIGS. 1A-1F, the cover 132 is shown as including only two attachment arms 136, which can also be referred to more descriptively as cover attachment arms 136. In alternative embodiments, the cover 132 can include more (e.g., four) cover attachment arms 136, each of which is attachable to the molded tray 112.

In the embodiment shown in FIGS. 1A-1F, a distal portion of each of the cover attachment arms 136 includes two tabs 138 that extend outward. As can be seen best in FIG. 1A, in order to attach the cover attachment arms 132 (and thereby the cover 132) to the molded tray 112, the distal portion of each of the cover attachment arms 136 is inserted through a respective slot 120 in the molded tray 112 while the tabs 138 are folded inward. The tabs 138 are then at least partially unfolded so that the tabs 138 extend outward from the distal portion of each of the cover attachment arms 136 and prevent the cover attachment arms 136 from being inadvertently detached from the molded tray 112. In the embodiment shown, each of the cover attachment arms 136 is shown as including two tabs 138. Alternatively, each of the cover attachment arms 136 can include a single tab 138, with the tabs 138 on the different cover attachment arms 136 preferably facing in different directions than one another. In a further embodiment, the tabs 138 and the slots 120 are eliminated, and the distal portions of the cover attachment arms 136 are instead attached to the molded tray 112 (e.g., to a glue flap thereof) by an adhesive. In still other embodiments, one or more of the cover attachment arms 136 is/are attached to the molded tray 112 using one or more of the tab(s) 138 and slot(s) 120, and one or more other cover attachment arms 136 is/are attached to the molded tray 112 by an adhesive.

In the embodiment shown in FIGS. 1A-1F, the handle 142 of the cover 132 includes a cutout or opening 144 into which a person can insert one or more fingers. In alternative embodiments the handle of the cover can include multiple cutouts or openings, e.g., with each for a separate finger. In further embodiments, the handle of the cover does not include any cutout or opening through which one or more finger(s) can be inserted, in which case the handle of the cover can be grasped between a person's thumb and one or more of their other fingers.

FIG. 1G shows a blank 152 of paperboard or cardboard that can be folded to produce the cover 132 including the handle 142. The blank 152 can be cut (e.g., die-cut) from a flat rectangular sheet of paperboard or cardboard. The dotted lines shown in FIG. 1G correspond to fold or crease lines that are mechanically added to the blank. The folding along the fold or crease lines can be performed autonomously, e.g., using a carton folding machine or a cartoning machine, or can be performed manually by hand. With the blank 152, the two portions of the blank that provide the handle 142 are folded or pinched toward one another, and the inner surfaces can be (but need not be) adhered to one another using an adhesive.

Figure 1H:
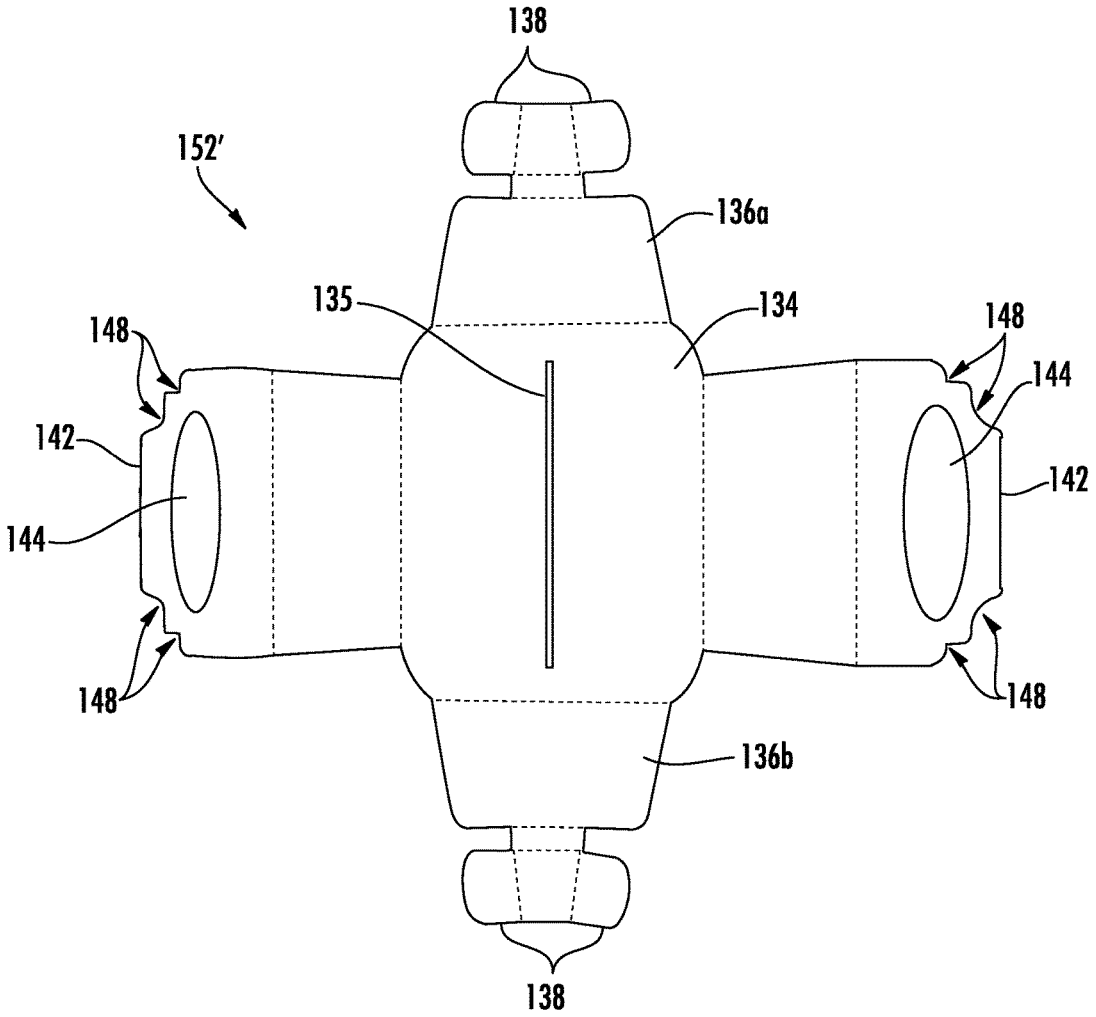

In FIGS. 1A-1F, the orientation of the handle 142 of the cover 132 and the orientation of the attachment arms 136 of the cover 132 are generally oriented in same direction. In alternative embodiments, the orientation of the handle of the cover and the orientation of the attachment arms of the cover can instead be generally perpendicular to one another. FIG. 1H shows a blank 152' of paperboard or cardboard that can be folded to produce a cover 132 including a handle 142, wherein the orientation of the handle of the cover and the orientation of the attachment arms of the cover are generally perpendicular to one another. The blank 152' can be cut (e.g., die-cut) from a flat rectangular sheet of paperboard or cardboard. The dotted lines shown in FIG. 1H correspond to fold or crease lines that are mechanically added to the blank manually or autonomously. The blank 152' is shown as including a slit 135 within the portion of the blank 152' that provides the upper surface of the horizontal planar portion 134 of the cover 132. Portions of the blank 152' that make up the handle 142 are folded back and inserted through the slit 135 so that the handle 142 extends upward relative to the horizontal planar portion 134 of the cover 132. The portions of the blank 152' that make up the attachment arms 136 are folded downward relative to the horizontal planar portion 134 of the cover 132.

Figure 2A:
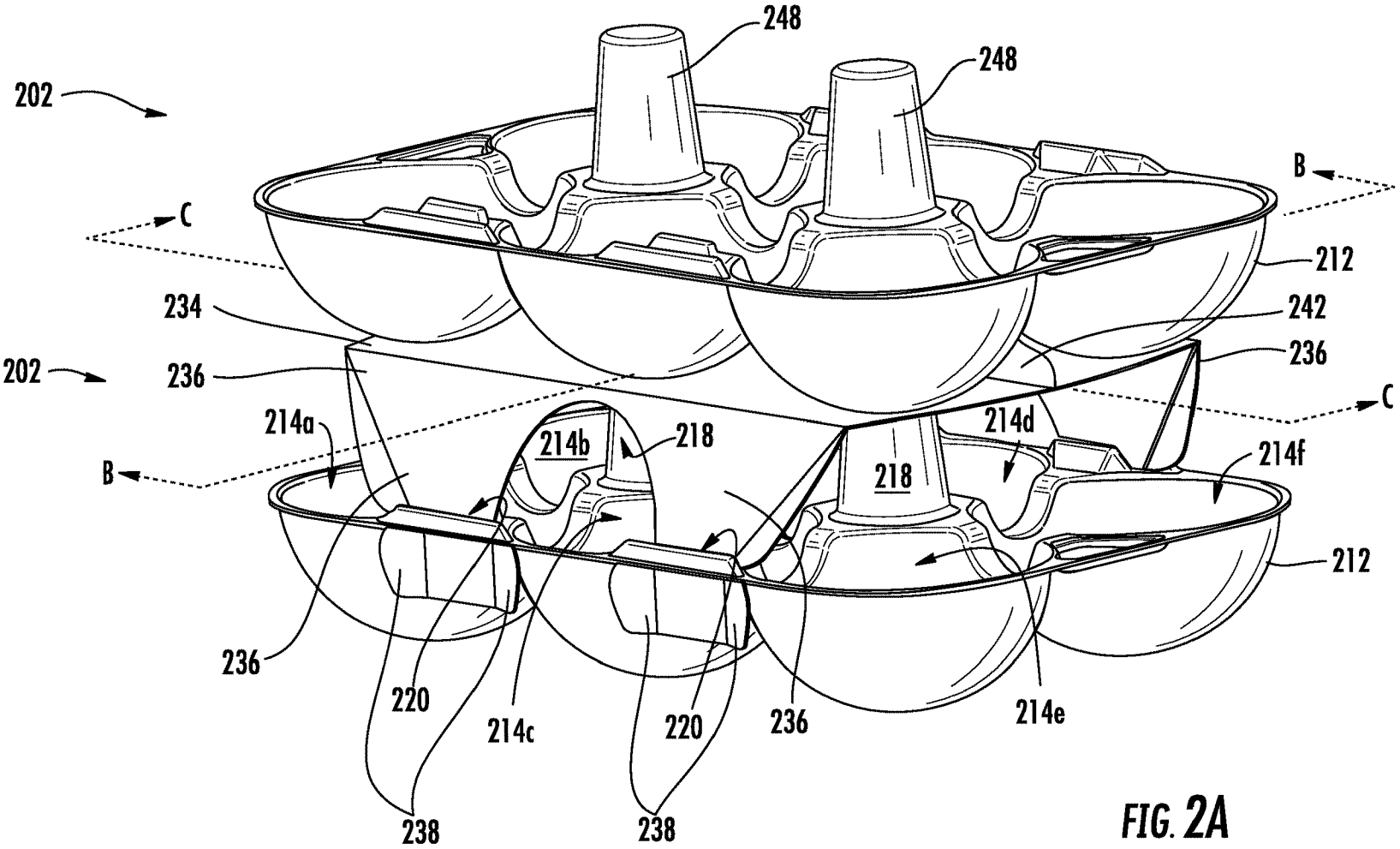
FIG. 2A a perspective view of two of the stackable packaging units, according to another embodiment of the present technology, stacked above the other.
Figure 2B:
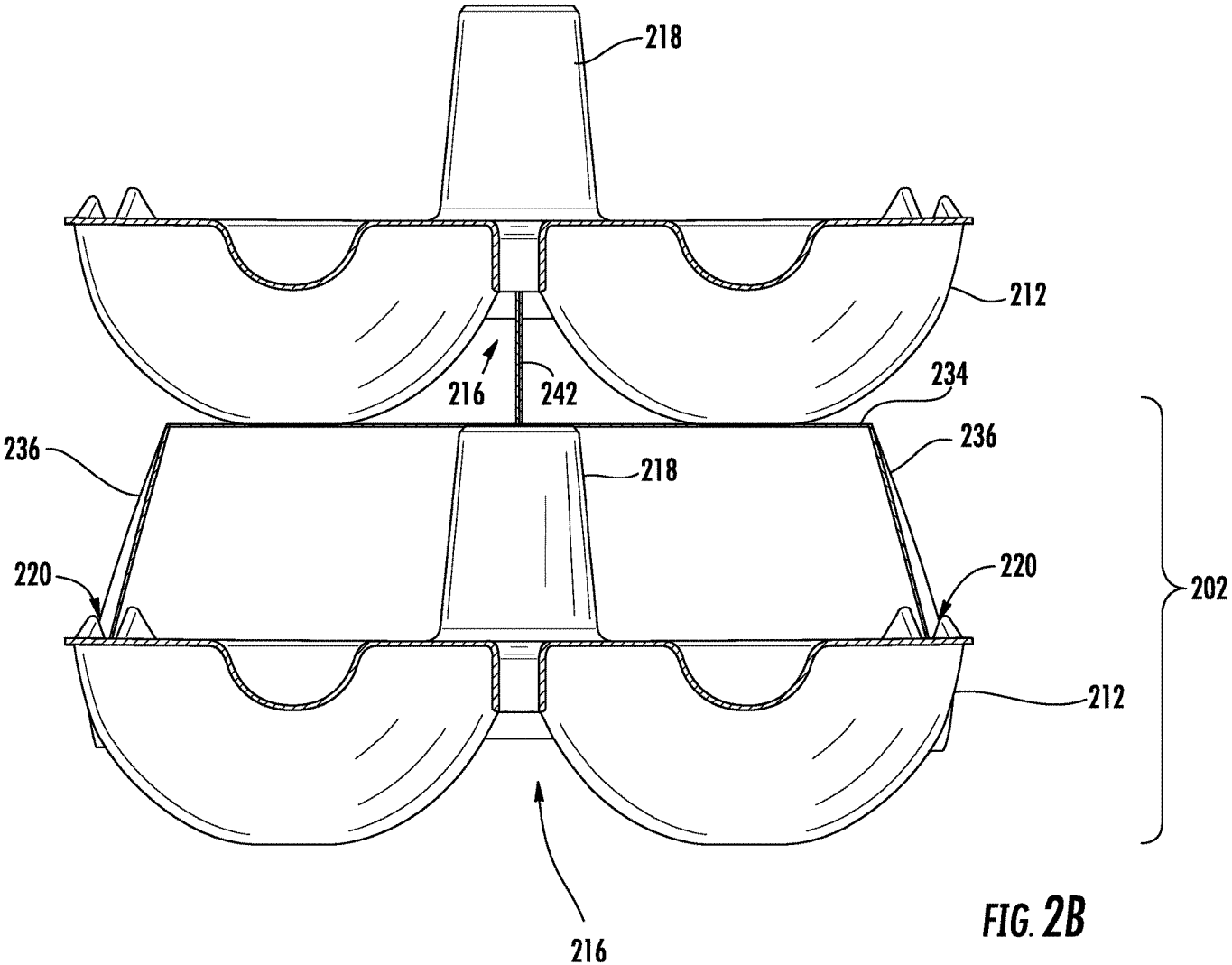
FIG. 2B is a cross section of the stackable packaging units introduced in FIG. 2A along the line B-B in FIG. 2A.
Figure 2C:
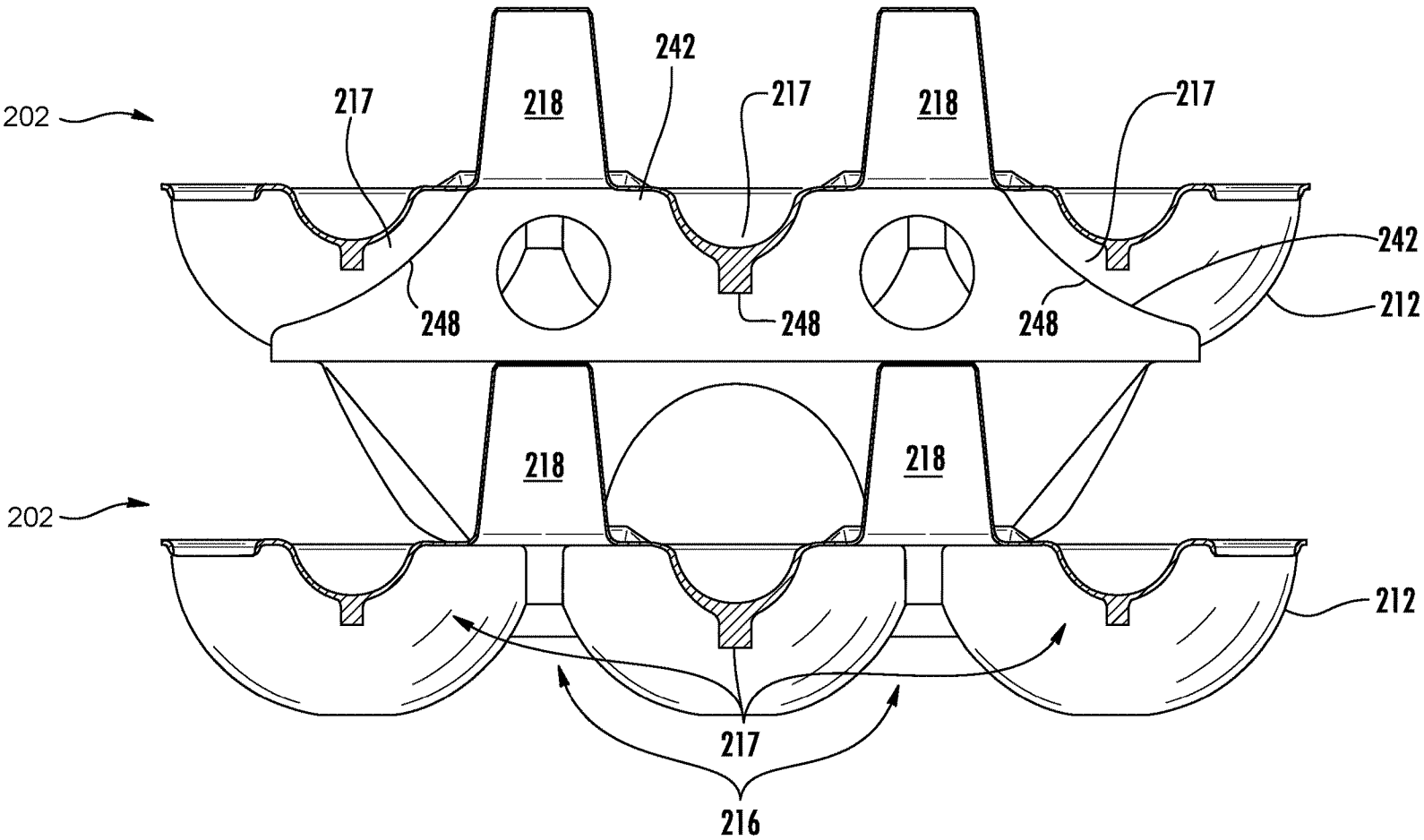
FIG. 2C is a cross section of the stackable packaging units introduced in FIG. 2A along the line C-C in FIG. 2A.
Figure 2D:
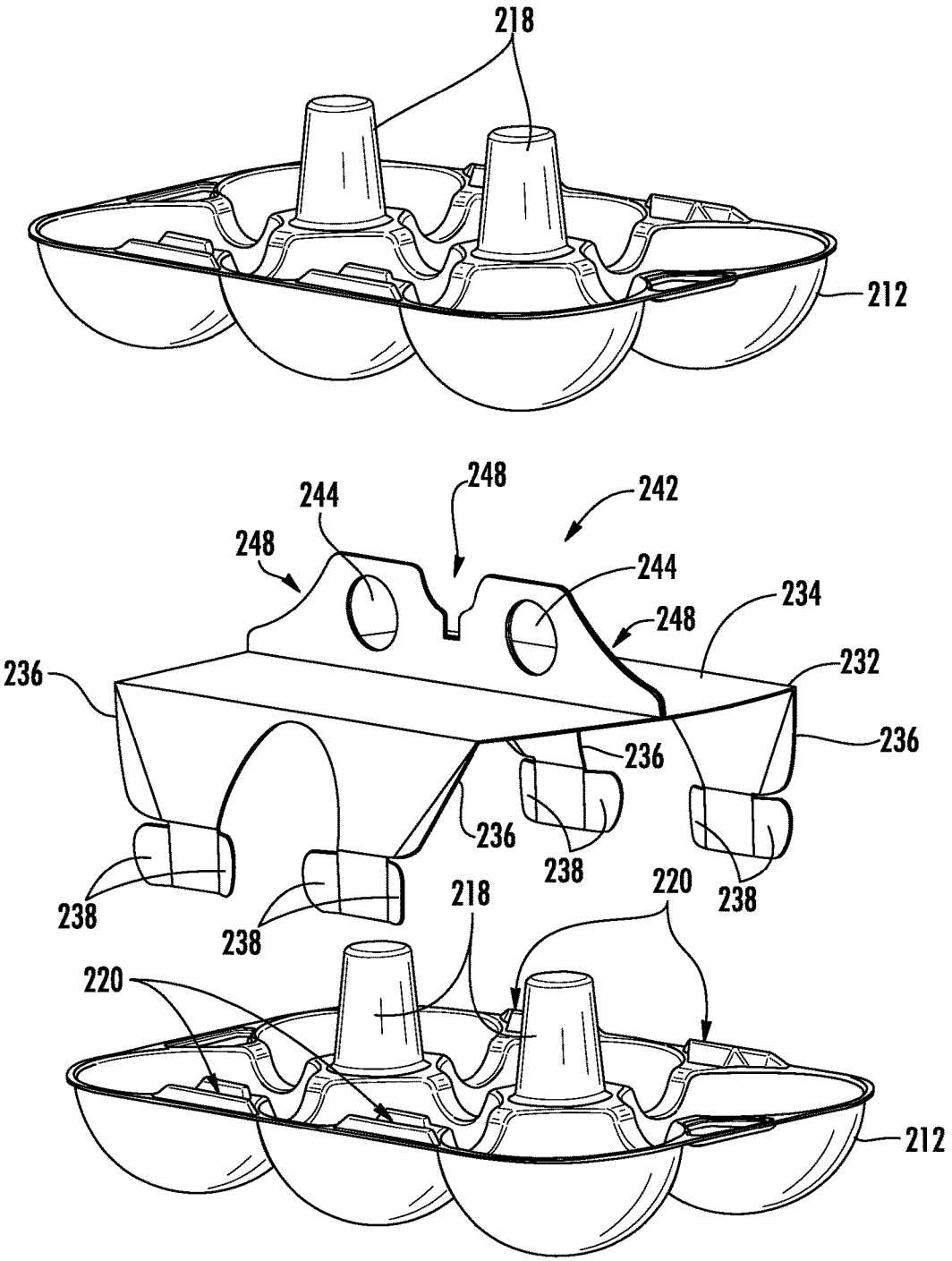
FIG. 2D is an exploded perspective view of stackable packaging units introduced in FIG. 2A.
Figure 2E:
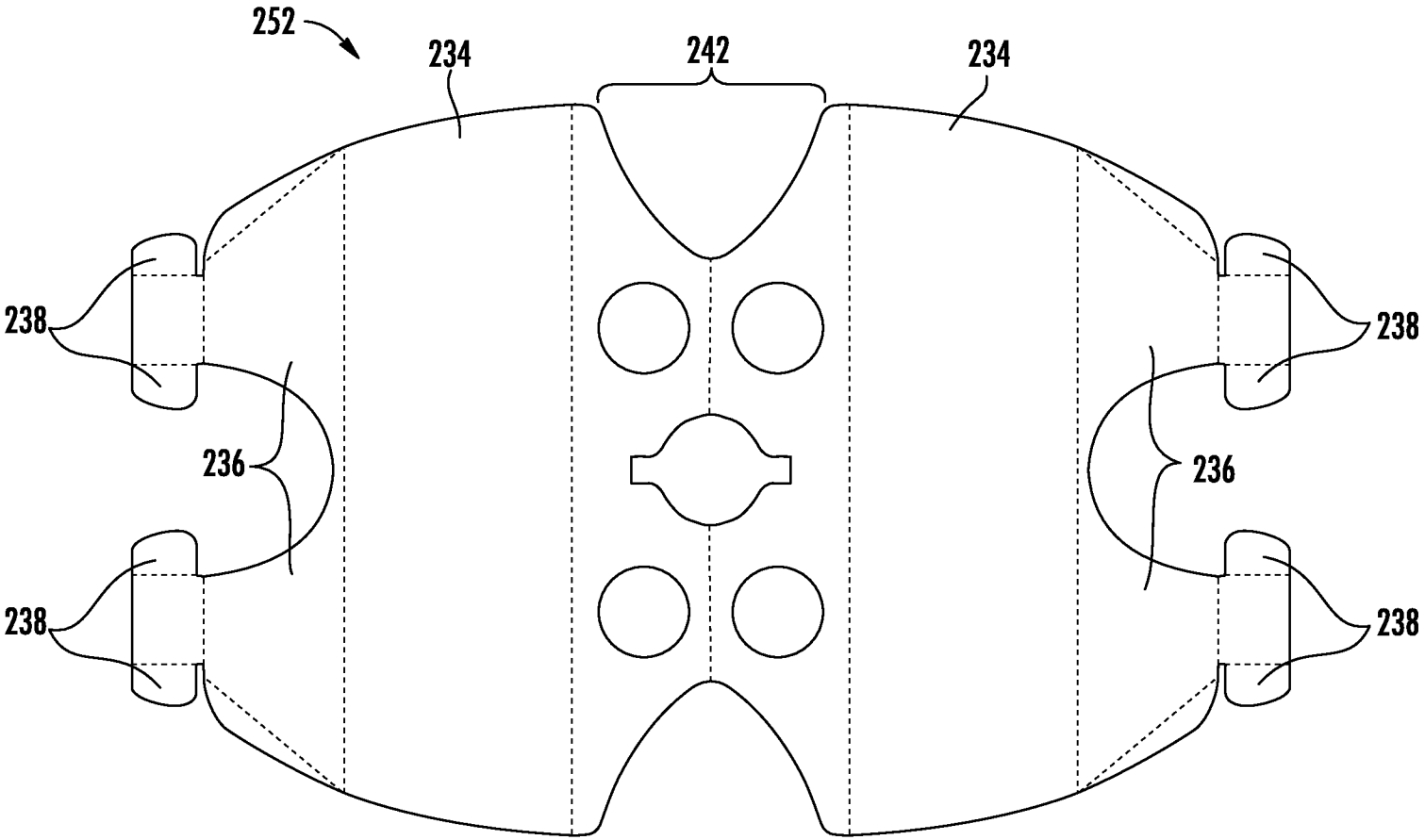
FIG. 2E shows how the cover of the stackable packaging unit introduced in FIG. 2A can be produced from a single sheet of paperboard or cardboard.

FIGS. 2A-2E will now be used to describe a stackable packaging unit 202, according to another embodiment of the present technology. More specifically, FIG. 2A is a perspective view of two of the stackable packaging unit 202, with one stacked above the other. FIG. 2B is a cross section of the stackable packaging units 202 along the line B-B in FIG. 2A, and FIG. 2C is a cross section of the stackable packaging units 202 along the line C-C in FIG. 2A. FIG. 2D is an exploded perspective view of stackable packaging units 202. FIG. 2E shows how the cover of the stackable packaging unit introduce in FIG. 2A can be produced from a single sheet of paperboard or cardboard.

Each of the stackable packaging units 202 is shown as including a molded tray 212 having six compartments 214*a*, 214*b*, 214*c*, 214*d*, 214*e* and 214*f*. The compartments 214*a*, 214*b*, 214*c*, 214*d*, 214*e* and 214*f* can be individually referred to as a compartment 214, or collectively as the compartments 214. The compartments 214 can also be referred to as cells. Exemplary details of how to produce the molded tray 212 are described below with reference to step 402 in FIG. 4.

While only shown on the lower one of the stackable packaging units 202 in FIGS. 2A-2D, each of the stackable packaging units 202 also includes a cover 232 that is made of folded paperboard or cardboard and is attached to the molded tray 212. The cover 232 is not shown on the upper one of the stackable packaging units 202 in FIGS. 2A-2D, so that the elements that would otherwise be obscured by the cover 232 can be more readily shown and described. Unless discussing the stackable and nestable aspects of the stackable packaging units 202, the lower complete stackable packaging unit 202 is primarily described below. The upper stackable packaging unit 202 in FIGS. 2A-2D would look just like the lower one, if the upper one included its cover 232.

The cover 232 is shown as covering a portion of each of the compartments 214, to thereby protect any items therein (if present), while still allowing the compartments 214 and any items therein (if present) to be at least partially visible. As was the case with the handle 142 of the cover 132, a handle 242 of the cover 232 provides a male feature that is configured to fit within a female feature 216 of a further one of the stackable packaging units 212 that is stacked above the stackable packaging unit 212. As was the case in the earlier described embodiments, the paperboard or cardboard from which the cover 232 (including its handle 242 and attachment arms 236) can be single-ply or multi-ply, and in the case of cardboard, can include a corrugated layer sandwiched between a pair of non-corrugated layers, each of which can be single-ply or multi-ply. The paperboard or cardboard from which the cover 232 is made can be partially or entirely made from postconsumer recycled material. Depending upon implementation, the paperboard or cardboard from which the cover 232 is made can itself be recyclable and/or compostable.

The molded tray 212 also includes a female feature 216 that is useful when stacking multiple ones of the stackable packaging unit 202 one above the other, as shown in FIGS. 2A-2C. In this embodiment, the female feature 216 extends upwards between the bottoms of adjacent groups of three of the compartments 214 of the molded tray 212. Additionally, the molded tray 212 includes two support columns 218 extending upward, but may include more or less than two support columns 218.

As was the case with the molded tray 112, the molded tray 212 is preferably made of molded pulp, but can alternatively made of molded plastic. Where the molded tray 212 is made from molded pulp and the cover 232 is made from paperboard or cardboard, the molded tray 212 and the cover 232, and thus the entire stackable packaging unit 202, can be recyclable and/or compostable. Further, where the molded tray 212 is made from molded pulp and the cover 232 is made from paperboard or cardboard, the molded tray 212 and the cover 232, and thus the entire stackable packaging unit 202, can include postconsumer recycled material, and can even be made of entirely of postconsumer recycled material.

Still referring to FIGS. 2A-2E, the cover 232 includes a horizontal planar portion 234, from which the handle 242 of the cover 232 extends upward. The horizontal planar portion 234 of the cover 232 provides a horizontal surface on which to rest the molded tray 212 of a further one of the stackable packaging units 202 that is stacked above the stackable packaging unit 202. Two regions of the horizontal planar portion 234 of the cover 232 rest on and are supported by the two support columns 218 of the molded tray 212. In this manner, the support columns 218 of the molded tray 212 prevent the horizontal planar portion 234 of the cover 232 from collapsing under the weight of a further one of the stackable packaging units 202 that is stacked above the stackable packaging unit 202 and is thereby resting on the horizontal planar portion 234.

The male feature provided by the handle 242, when fit within the female feature 216 of another stackable packaging unit 202 that is stacked above the stackable packaging unit 202, inhibits (and preferably prevents) the upper stackable packaging unit 202 from sliding horizontally to-and-fro and/or side-to-side relative to the cover 232 upon which the upper stackable packaging unit 202 rests, but allows the upper one of the stackable packaging units 202 to be lifted up vertically relative to the cover 232 upon which the upper stackable packaging unit 202 rests. Accordingly, a plurality of the stackable packaging units 202 are not only stackable, but also nestable or interlocking.

In the embodiment shown in FIGS. 2A-2E, the female feature 216 included in the molded tray 212 includes protrusions 217, and the male feature provided by the handle 242 includes indentations 248 that are configured that mate with respective protrusions 217 of the female feature 216 of a further one of the stackable packaging units 202 that is stacked above the stackable packaging unit 202. In alternative embodiments, the female feature included in the molded tray includes indentations, and the male feature provided by the handle includes protrusions that are configured that mate with respective indentations of the female feature of a further one of the stackable packaging units that is stacked above the stackable packaging unit. More generally, the male feature provided by the handle can include one or more indentations and/or protrusions (and/or other profile shapes) that is/are configured that mate with respective protrusions and/or indentations (and/or other profile shapes) of the female feature of a further one of the stackable packaging units that is stacked above the stackable packaging unit.

In the embodiment shown in FIGS. 2A-2E, the cover 232 includes four cover attachment arms 236 that extend downward (albeit at an angle) from the horizontal planar portion 234 of the cover 232, and are used to attach the cover 232 to the molded tray 212. The cover 232 can alternatively include more or less than four attachment arms 236, but should preferably include at least two cover attachment arms 236, e.g., as was the case with the embodiment described above with reference to FIGS. 1A-1F. As was the case with the cover attachment arms 136 described above with reference to FIGS. 1A-1F, a distal portion of each of the cover attachment arms 236 are shown as including two tabs 238 that extend outward, which can be used to prevent the cover attachment arms 236 from being inadvertently detached from the molded tray 212 after being inserted through respective slots 220 in the molded tray 212. In the embodiment shown, each of the cover attachment arms 236 is shown as including two tabs 238, but can alternatively each include a single tab 238. In another embodiment, the tabs and the slots are eliminated, and the distal portions of the cover attachment arms 236 are instead attached to the molded tray 212 (e.g., to a glue flap thereof) by an adhesive. In still other embodiments, one or more of the cover attachment arms 236 is/are attached to the molded tray 212 using one or more of the tab(s) and slot(s), and one or more other cover attachment arms 236 is/are attached to the molded tray 212 by an adhesive.

As best seen in FIGS. 2C and 2D, the handle 242 of the cover 232 includes two cutouts or openings 244 into which a person can insert two fingers. In alternative embodiments the handle of the cover can include more or less cutouts or openings, and can even include no cutout or opening through which finger(s) can be inserted. Where the handle includes no cutout or opening through which finger(s) can be inserted, the handle of the cover can be grasped between a person's thumb and one or more of their other fingers.

FIG. 2E shows a blank 252 of paperboard or cardboard that can be folded to produce the cover 232 including the handle 242. The blank 252 can be cut (e.g., die-cut) from a flat rectangular sheet of paperboard or cardboard. The dotted lines shown in FIG. 2E correspond to fold or crease lines that are mechanically added to the blank. The folding along the fold or crease lines can be performed autonomously, e.g., using a carton folding machine or a cartoning machine, or can be performed manually by hand. In accordance with an embodiment, the two portions of the blank that provide the handle 242 are folded or pinched toward one another, and the inner surfaces can be (but need not be) adhered to one another using an adhesive. In an alternative embodiment, a blank can include a slit (e.g., similar to the slit 135 in FIG. 1H) within the portion of the blank that provides the upper surface of the horizontal planar portion of the cover, and portions of the blank that make up the handle can be folded back and inserted through the slit so that the handle extends upward relative to the horizontal planar portion of the cover, in a similar manner as was described above with reference to FIG. 1H. In this alternative embodiment, the orientation of the handle of the cover and the orientation of the attachment arms of the cover would be generally perpendicular to one another.

Figure 3A:
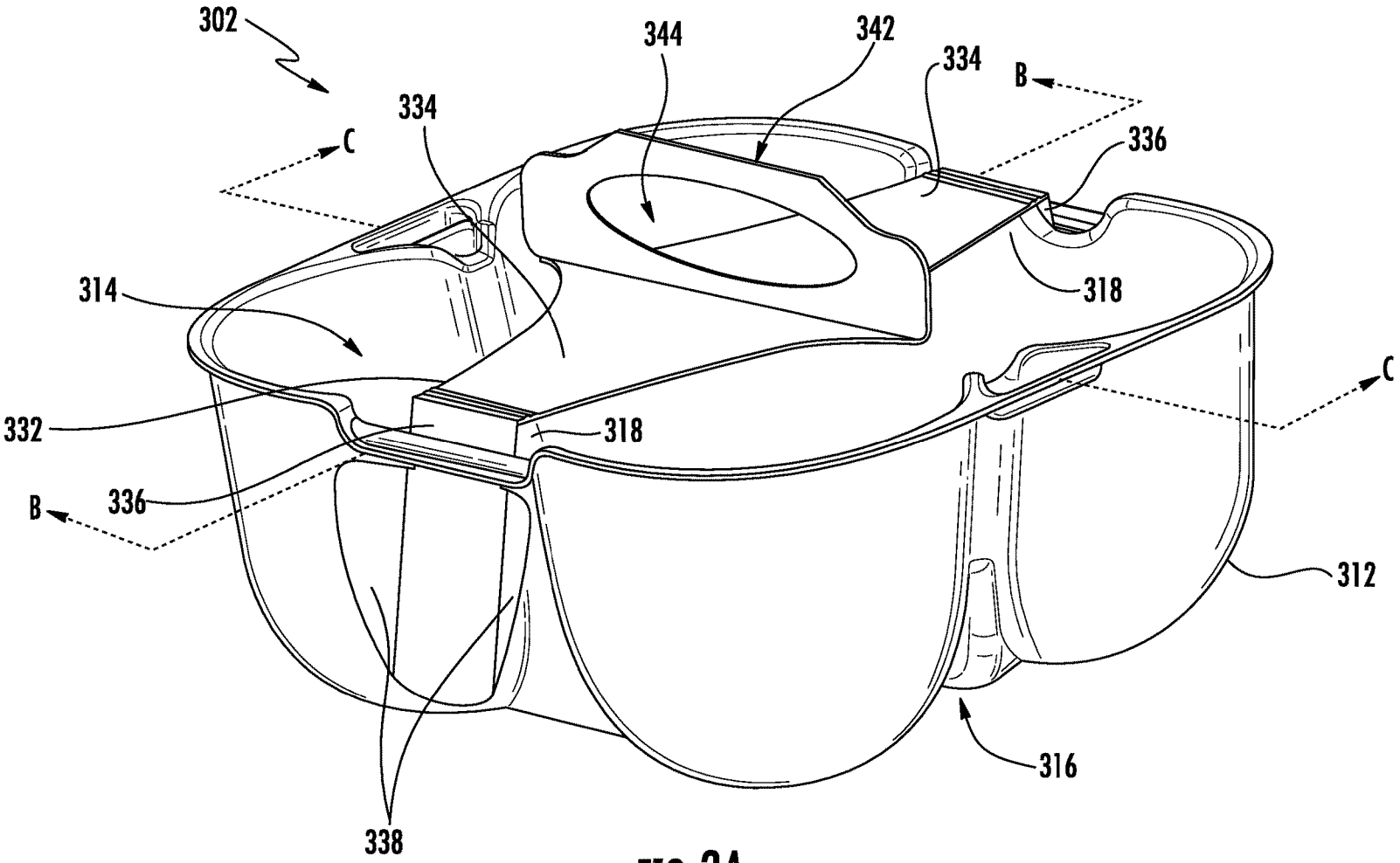
FIG. 3A a perspective view of a stackable packaging unit, according to another embodiment of the present technology.
Figure 3B:
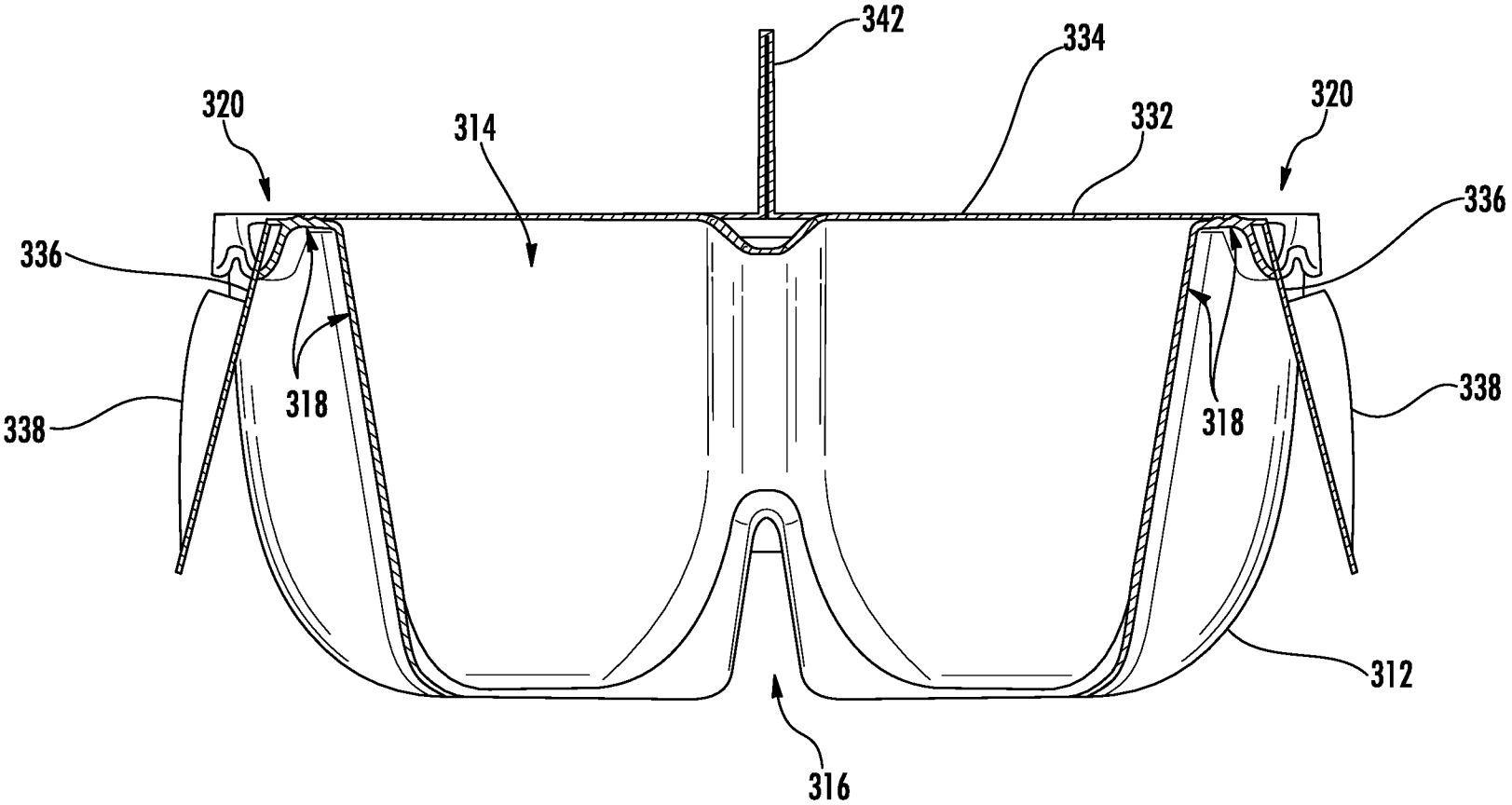
FIG. 3B is a cross section of the stackable packaging unit introduced in FIG. 3A along the line B-B in FIG. 3A.
Figure 3C:
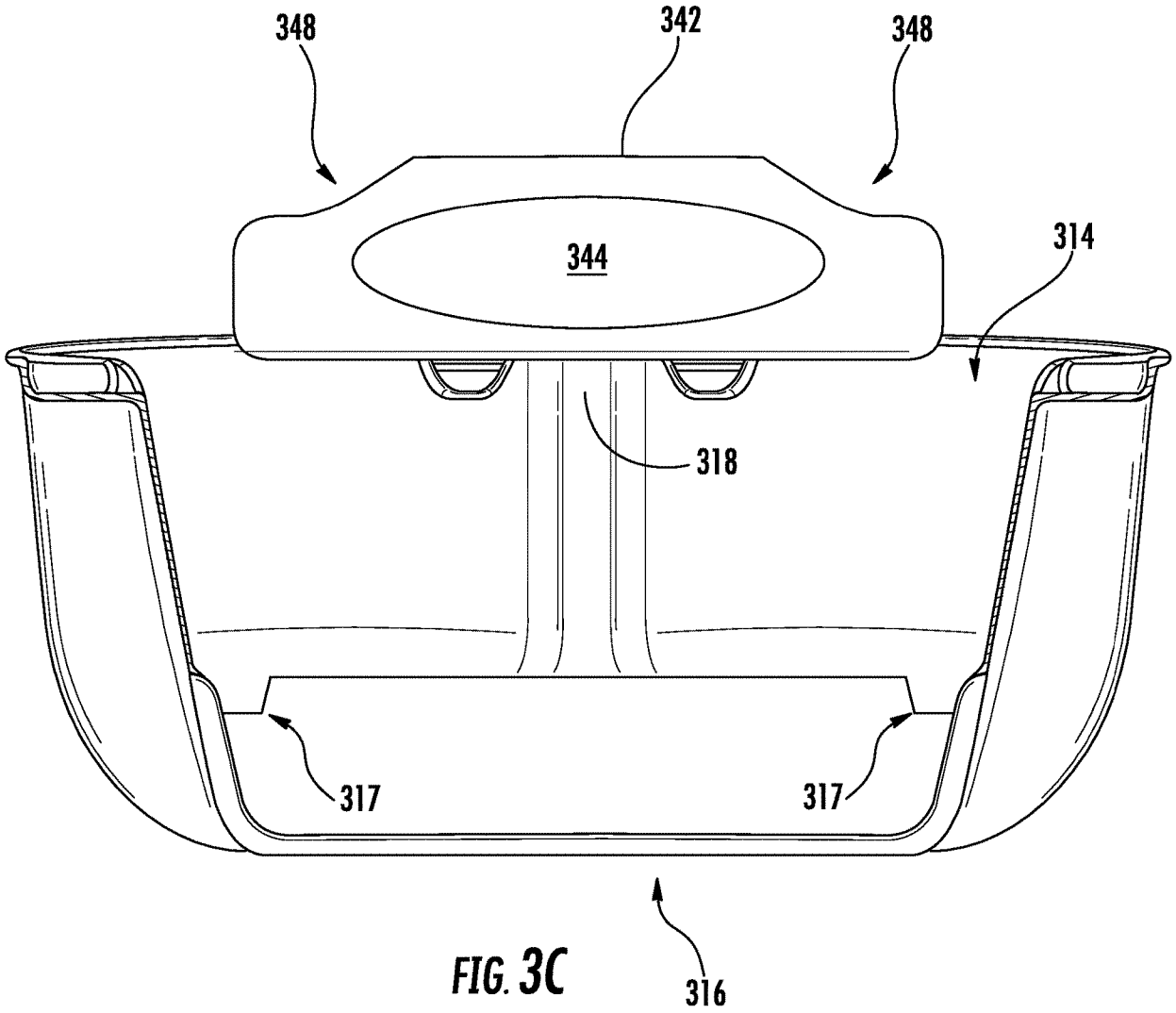
FIG. 3C is a cross section of the stackable packaging unit introduced in FIG. 3A along the line C-C in FIG. 3A.
Figure 3D:
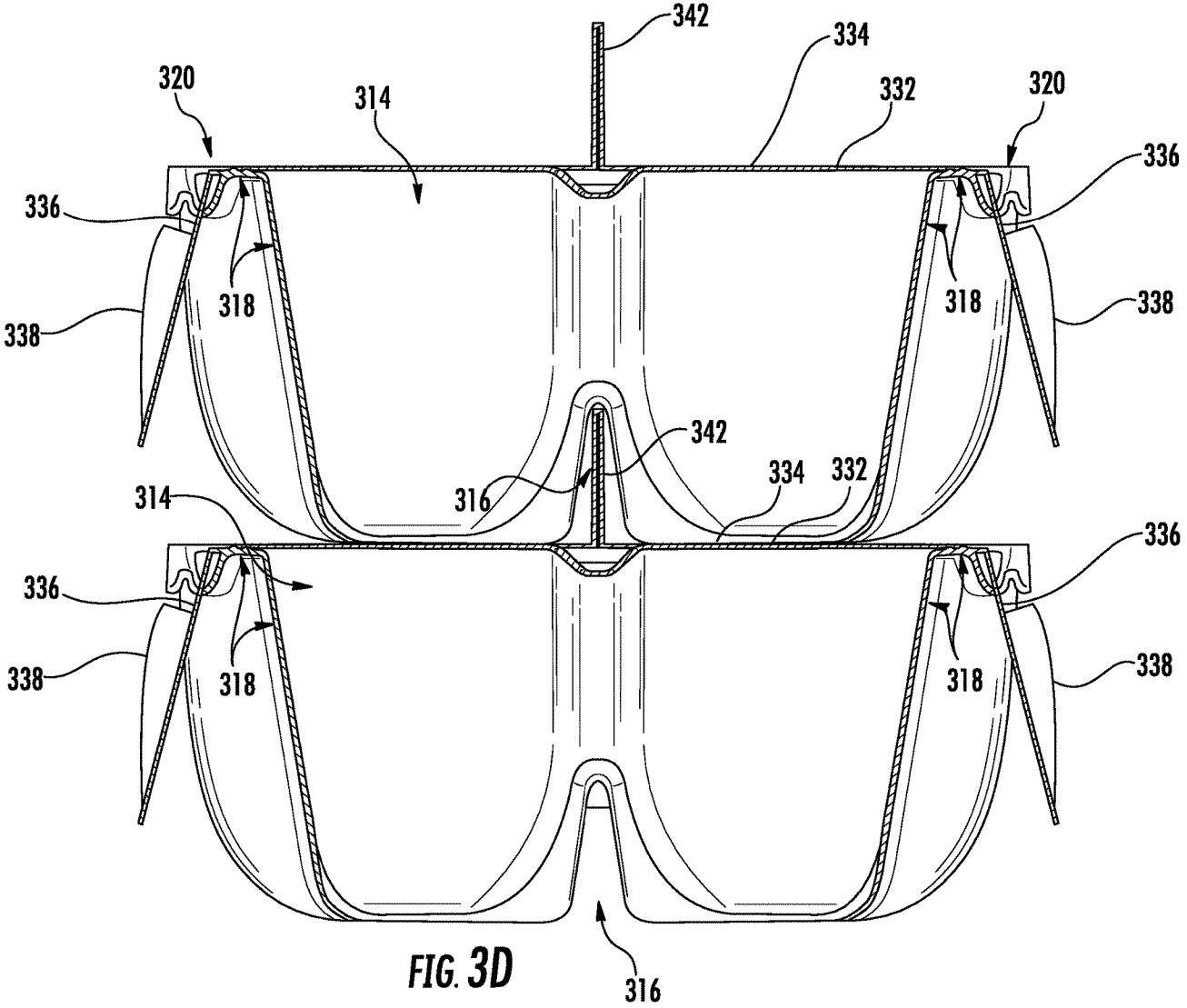
FIG. 3D is similar to FIG. 3B, in that it is a cross section of the stackable packaging unit along the line B-B in FIG. 3A, but shows how two of the stackable packaging units can be stacked one above the other.
Figure 3E:
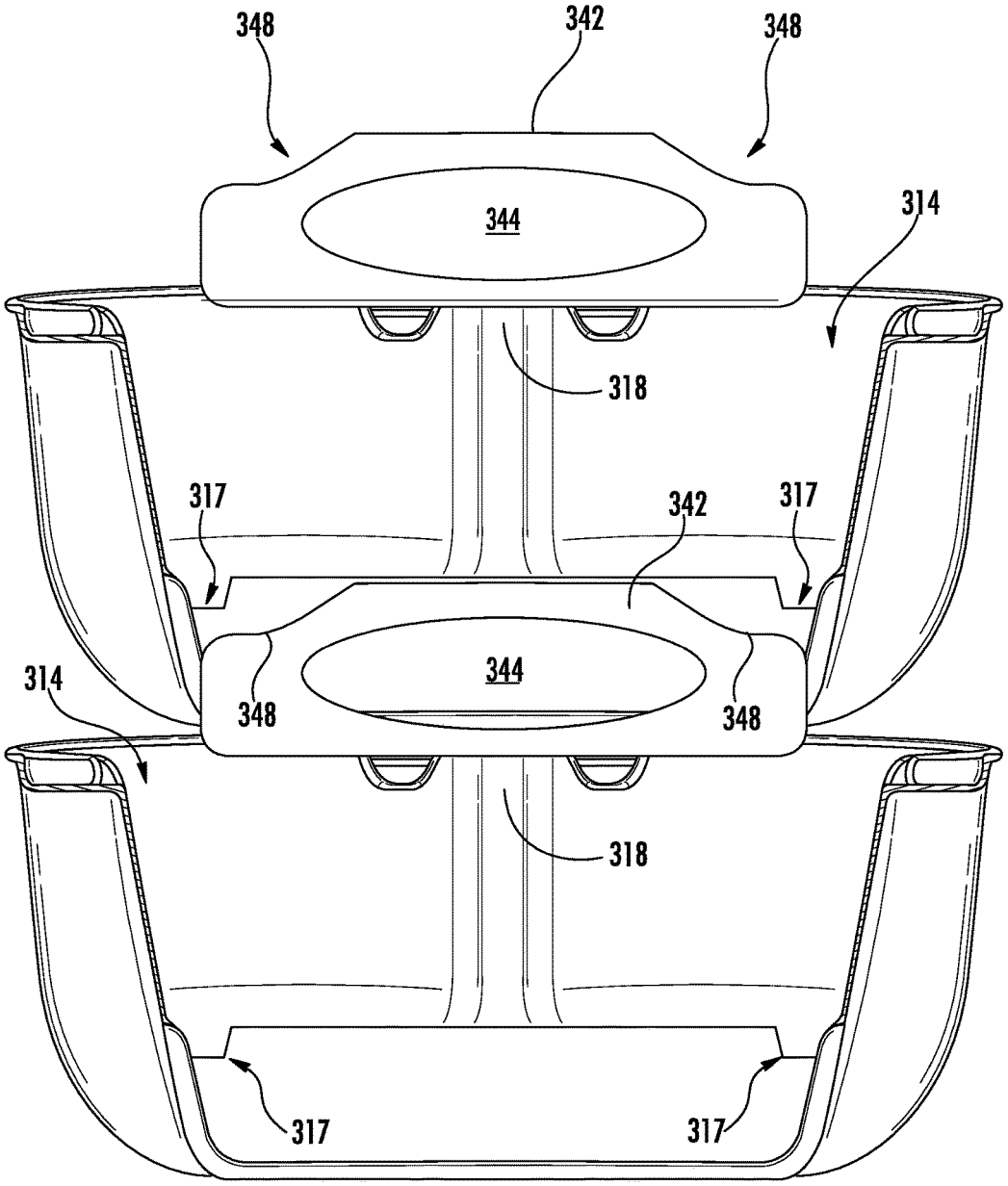
FIG. 3E is similar to FIG. 3C, in that it is a cross section of the stackable packaging unit along the line C-C in FIG. 3A, but shows how two of the stackable packaging units can be stacked one above the other.
Figure 3F:
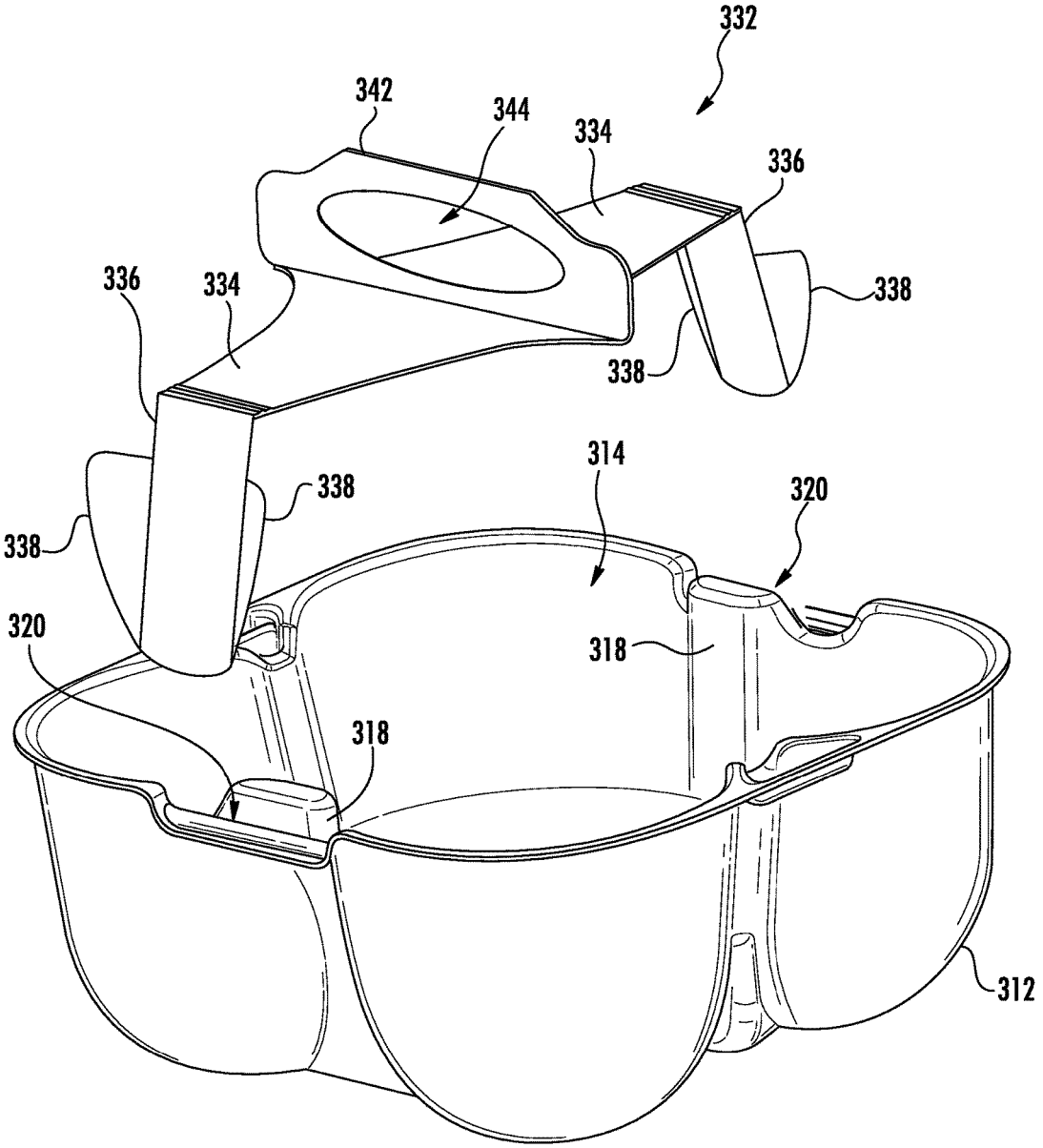
FIG. 3F is an exploded perspective view of stackable packaging units introduced in FIG. 3A.
Figure 3G:
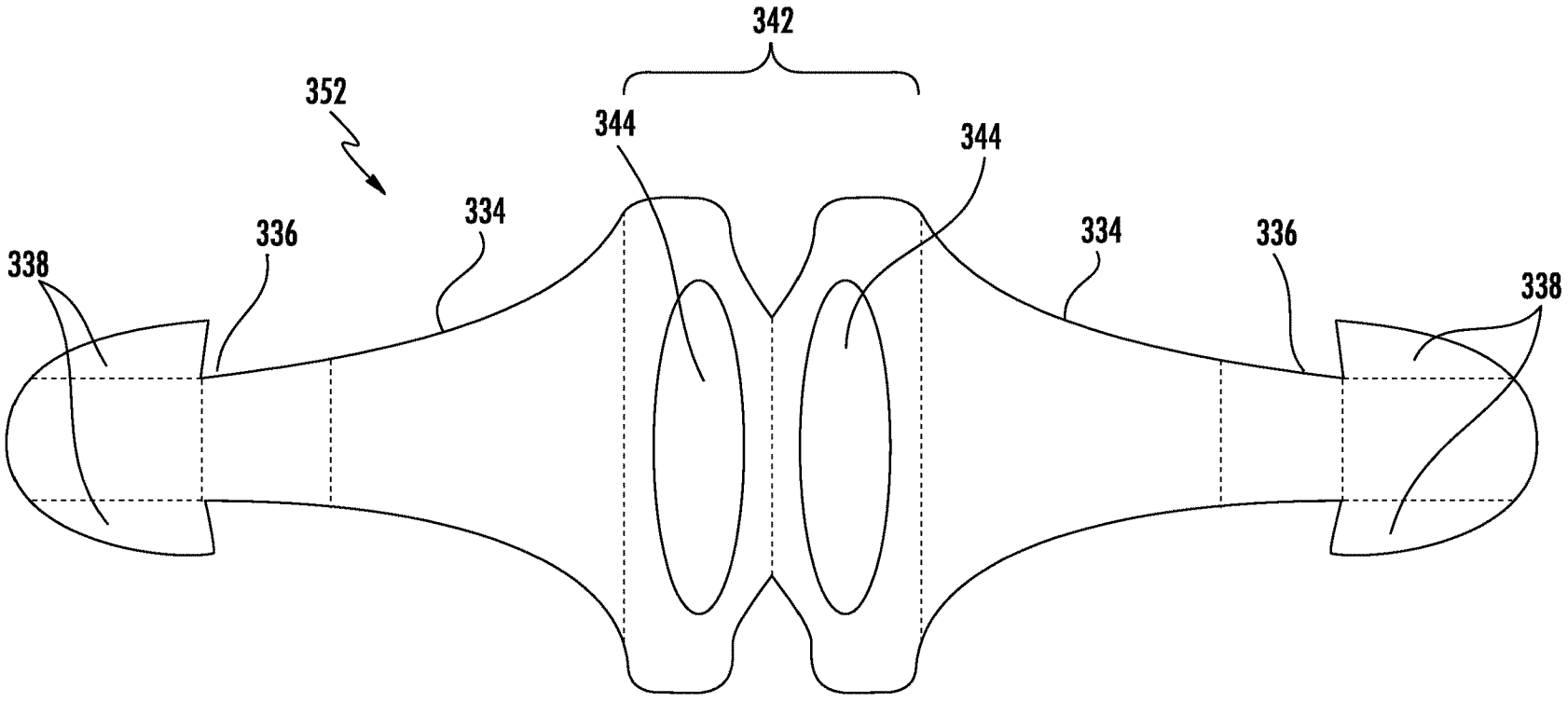
FIG. 3G shows how the cover of the stackable packaging unit introduced in FIG. 3A can be produced from a single sheet of paperboard or cardboard.

FIGS. 3A-3G will now be used to describe a stackable packaging unit 302, according to another embodiment of the present technology. More specifically, FIG. 3A is a perspective view of the stackable packaging unit 302. FIG. 3B is a cross section of the stackable packaging unit 302 along the line B-B in FIG. 3A, and FIG. 3C is a cross section of the stackable packaging unit 302 along the line C-C in FIG. 3A. FIG. 3D is similar to FIG. 3B, in that it is a cross section of the stackable packaging unit along the line B-B in FIG. 3A, but shows how two of the stackable packaging units 302 can be stacked one above the other. FIG. 3E is similar to FIG. 3C, in that it is a cross section of the stackable packaging unit along the line C-C in FIG. 3A, but shows how two of the stackable packaging units 302 can be stacked one above the other. FIG. 3F is an exploded perspective view of stackable packaging unit 302 introduced in FIG. 3A. FIG. 3G shows how the cover of the stackable packaging unit 302 introduced in FIG. 3A can be produced from a single sheet of paperboard or cardboard.

Each of the stackable packaging units 302 is shown as including a molded tray 312 having a single compartment 314, which can also be referred to as a cell. The single compartment can hold a single item, or a plurality of items. Exemplary details of how to produce the molded tray 312 are described below with reference to step 402 in FIG. 4. The stackable packaging unit 302 is also shown as including a cover 332 that is made of folded paperboard or cardboard and is attached to the molded tray 312. The cover 332 is shown as covering a portion of the compartment 314, to thereby protect any one or more items therein (if present), while still allowing the compartment 314 and any item(s) therein (if present) to be at least partially visible. A handle 342 of the cover 332 provides a male feature that is configured to fit within a female feature 316 of a further one of the stackable packaging units 312 that is stacked above the stackable packaging unit 312. As was the case in the earlier described embodiments, the paperboard or cardboard from which the cover 332 (including its handle 342 and attachment arms 336) can be single-ply or multi-ply, and in the case of cardboard, can include a corrugated layer sandwiched between a pair of non-corrugated layers, each of which can be single-ply or multi-ply. The paperboard or cardboard from which the cover 332 is made can be partially or entirely made from postconsumer recycled material, and itself can be recyclable and/or compostable.

The molded tray 312 also includes a female feature 316 that is useful when stacking multiple ones of the stackable packaging unit 302 one above the other. In this embodiment, the female feature 316 extends partially into the bottom of the single compartment 314 of the molded tray 312. In contrast to the previously described embodiments, the molded tray 312 does not include support columns (e.g., similar to 118 or 218) extending upward from a central region of the molded tray. Rather, in this embodiment, support columns 318 extend along or from opposing side walls of the molded tray 312. Other variations are also possible, and within the scope of the embodiments described herein.

The molded tray 312 is preferably made of molded pulp, but can alternatively made of molded plastic. Where the molded tray 312 is made from molded pulp and the cover 332 is made from paperboard or cardboard, the molded tray 312 and the cover 332, and thus the entire stackable packaging unit 302, can be recyclable and/or compostable. Further, where the molded tray 312 is made from molded pulp and the cover 332 is made from paperboard or cardboard, the molded tray 312 and the cover 332, and thus the entire stackable packaging unit 302, can include postconsumer recycled material, and can even be made of entirely of postconsumer recycled material.

Still referring to FIGS. 3A-3G, the cover 332 includes a horizontal planar portion 334, from which the handle 342 of the cover 332 extends upward. The horizontal planar portion 334 of the cover 332 provides a horizontal surface on which to rest the molded tray 312 of a further one of the stackable packaging units 302 that is stacked above the stackable packaging unit 302.

The male feature provided by the handle 342, when fit within the female feature 316 of another stackable packaging unit 302 that is stacked above the stackable packaging unit 302, inhibits (and preferably prevents) the upper stackable packaging unit 302 from sliding horizontally to-and-fro and/or side-to-side relative to the cover 332 upon which the upper stackable packaging unit 302 rests, but allows the upper one of the stackable packaging units 302 to be lifted up vertically relative to the cover 332 upon which the upper stackable packaging unit 302 rests. Accordingly, a plurality of the stackable packaging units 302 are not only stackable, but also nestable or interlocking.

In the embodiment shown in FIGS. 3A-3G, the female feature 316 included in the molded tray 312 includes protrusions 317, and the male feature provided by the handle 342 includes indentations 348 that are configured that mate with respective protrusions 317 of the female feature 316 of a further one of the stackable packaging units 302 that is stacked above the stackable packaging unit 302. In alternative embodiments, the female feature included in the molded tray includes indentations, and the male feature provided by the handle includes protrusions that are configured that mate with respective indentations of the female feature of a further one of the stackable packaging units that is stacked above the stackable packaging unit. More generally, the male feature provided by the handle can include one or more indentations and/or protrusions (and/or other profile shapes) that is/are configured that mate with respective protrusions and/or indentations (and/or other profile shapes) of the female feature of a further one of the stackable packaging units that is stacked above the stackable packaging unit.

In the embodiment shown in FIGS. 3A-3G, the cover 332 includes two cover attachment arms 336 that extend downward (albeit at an angle) from the horizontal planar portion 334 of the cover 332, and are used to attach the cover 332 to the molded tray 312. The cover 332 can alternatively include more than two attachment arms 336. A distal portion of each of the cover attachment arms 336 are shown as including two tabs 338 that extend outward, which can be used to prevent the cover attachment arms 336 from being inadvertently detached from the molded tray 312 after being inserted through respective slots 320 in the molded tray 312. In the embodiment shown, each of the cover attachment arms 336 is shown as including two tabs 338, but can alternatively each include a single tab 338. In another embodiment, the tabs and the slots are eliminated, and the distal portions of the cover attachment arms 336 are instead attached to the molded tray 312 (e.g., to a glue flap thereof) by an adhesive. In still other embodiments, one or more of the cover attachment arms 336 is/are attached to the molded tray 312 using one or more of the tab(s) and slot(s), and one or more other cover attachment arms 336 is/are attached to the molded tray 312 by an adhesive.

As best seen in FIGS. 3A and 3C, the handle 342 of the cover 332 includes a cutout or opening 344 into which a person can insert one or more fingers. In alternative embodiments the handle of the cover can include more or less cutouts or openings, and can even include no cutout or opening through which finger(s) can be inserted. Where the handle includes no cutout or opening through which finger(s) can be inserted, the handle of the cover can be grasped between a person's thumb and one or more of their other fingers.

FIG. 3G shows a blank 352 of paperboard or cardboard that can be folded to produce the cover 332 including the handle 342. The blank 352 can be cut (e.g., die-cut) from a flat rectangular sheet of paperboard or cardboard. The dotted lines shown in FIG. 3G correspond to fold or crease lines that are mechanically added to the blank. The folding along the fold or crease lines can be performed autonomously, e.g., using a carton folding machine or a cartoning machine, or can be performed manually by hand. The two portions of the blank 352 that provide the handle 342 are folded or pinched toward one another, and the inner surfaces can be (but need not be) adhered to one another using an adhesive. In this embodiment, the orientation of the handle of the cover and the orientation of the attachment arms of the cover are generally parallel to one another. In an alternative embodiment, a blank can include a slit (e.g., similar to the slit 135 in FIG. 1H) within the portion of the blank that provides the upper surface of the horizontal planar portion of the cover, and portions of the blank that make up the handle can be folded back and inserted through the slit so that the handle extends upward relative to the horizontal planar portion of the cover, in a similar manner as was described above with reference to FIG. 1H. In this alternative embodiment, the orientation of the handle of the cover and the orientation of the attachment arms of the cover would be generally perpendicular to one another.

The covers described herein (e.g., the covers 132, 232 and 332), since they are made of folded blanks for paperboard or cardboard, can also be referred to as "folded carton" or "folding carton" covers. Accordingly, in accordance with certain embodiments of the present technology described herein, each of the stackable packaging units described herein (e.g., 102, 202 and 302) comprises a combination of a molded pulp tray (e.g., 112, 212 and 312) and a folded carton cover (e.g., 132, 232 and 332) having a handle (e.g., 142, 242 and 342).

Figure 4:
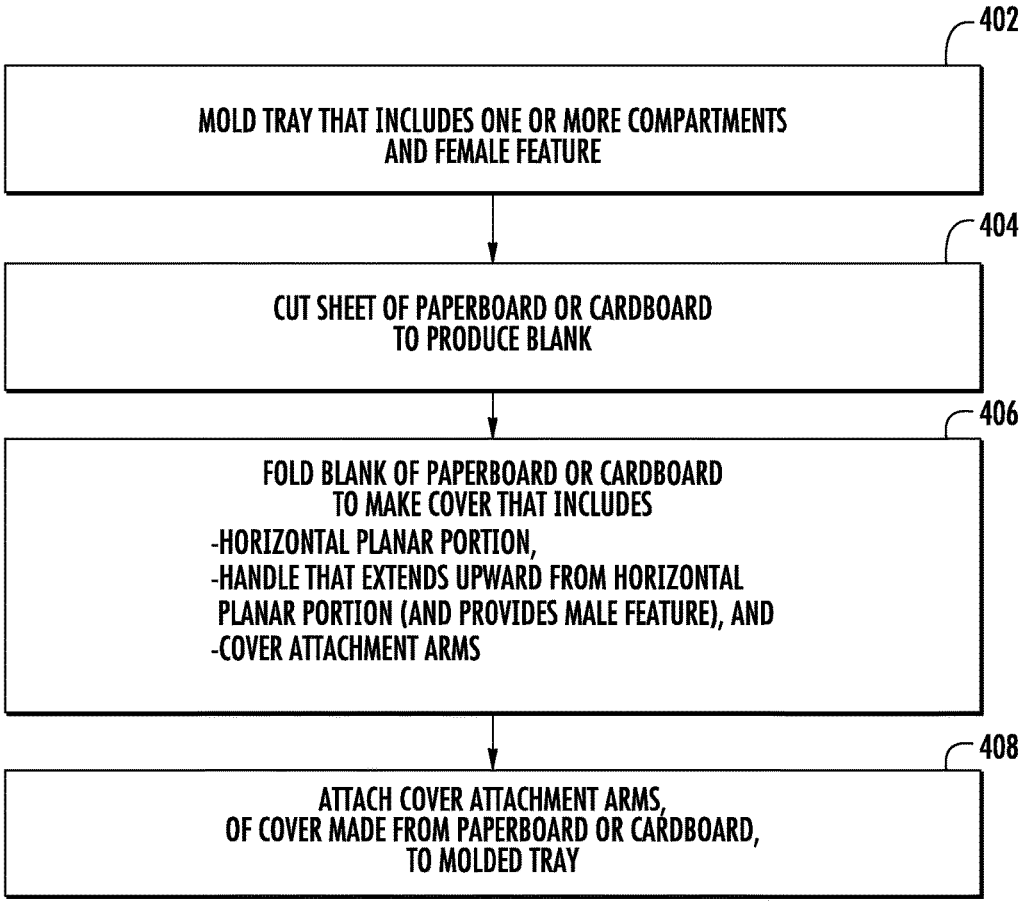
FIG. 4 is a high level flow diagram that is used to summarize various methods for manufacturing a stackable packaging unit, according to embodiments of the present technology.

The high level flow diagram of FIG. 4 will now be used to summarize methods for manufacturing a stackable packaging unit, according to various embodiments of the present technology. Referring to FIG. 4, step 402 involves molding a tray that includes one or more compartments and a female feature. Exemplary molded trays that can be produced step 402 include the molded trays 112, 212 and 312 described above, but are not limited thereto. Exemplary female features 116, 216 and 316 were described above and shown in the previously discussed FIGS. In accordance with preferred embodiments, step 402 involves molding the tray from pulp to produce a molded pulp tray. Molded pulp, which is also known as moulded pulp or molded fiber, can be made from one or more types of fibrous materials, such as recycled paper, newsprint, paperboard, or cardboard, and/or from natural fibers, such as, but not limited to, switchgrass, sugarcane, bamboo and/or wheat straw. Such molded pulp can, for example, be produced by combining water with reclaimed newspaper, paperboard and/or cardboard to create a slurry, which is then drawn into or otherwise placed in a mold. Molded pulp packaging is formed to shape, and thus, unlike cardboard or paperboard boxes, it does not start as a flat sheet. Instead, it can be designed with round corners and complex three-dimensional shapes, such as those of egg cartons.

There are various different ways in which the molded tray (e.g., 112, 212 or 312) can be manufactured at step 402. For example, in one technique the molded tray can be molded using a single mold to provide thick walls ranging from 3/16 to 3/8 inches. In another technique, the molded tray can be molded using one forming mold and one transfer mold to provide walls having a thickness ranging from 1/8 to 3/16 inches. In a further technique, the molded tray can be thermoformed using multiple heated molds to provide walls having a thickness ranging from 3/32 to 5/32 inches. Secondary and/or special treatment process can also be used make the molded tray from molded pulp. If desired, the molded tray that is made from molded pulp can be made waterproof with a spray or dip coating of wax. The pulp from which the molded tray is made can be made from recycled material. It is also noted that a molded pulp tray can be recyclable and/or compostable, depending upon what it is made of.

In accordance with alternative embodiments, step 402 involves molding the tray from plastic, which may be clear or opaque. The plastic from which the molded tray is made can be made from recycled material. It is also noted that the plastic from which the molded tray is made can be recyclable and/or compostable. Exemplary compostable plastics may be made from corn starch, potato starch, soybean protein, or cellulose, but are not limited thereto.

Step 404 involves cutting a sheet of paperboard or cardboard in accordance with a pattern to provide a paperboard or cardboard blank. Exemplary blanks that can be produced step 404 include, but are not limited to, the blanks 152, 152', 252 and 352 described above. Step 404 can be performed, e.g., using a die cutting machine.

Step 406 involves folding the blank of paperboard or cardboard to make a cover that includes a horizontal planar portion, a handle that extends upward from the horizontal planar portion (and provides a male feature), and at least two cover attachment arms. Exemplary covers that can be produced step 406 include, but are not limited to, the covers 132, 232 and 332 described above. Step 406 can be performed, e.g., using a box folding machine.

Step 408 involves attaching the cover attachment arms, of the cover made from the paperboard or cardboard, to the molded tray. In accordance with certain embodiments, step 408 includes attaching distal portions of one or more of the cover attachment arms to the molded tray using an adhesive. Alternatively, or additionally, step 408 can include folding in one or more tabs (e.g., 138, 238 or 338) that extend outward from a distal portion of one or more of the cover attachment arms (e.g., 136, 236 or 336), inserting the distal portion of one or more of the cover attachment arms into a respective slot (e.g., 120, 220 or 320) in the molded tray, and at least partially unfolding the one or more tabs that extend outward from the distal portion of one or more of the cover attachment arms so that the unfolded tab(s) prevent the distal portion of the one or more cover attachment arms from sliding out of its respective slot in the molded tray.

While step 408 must be performed after step 406, and step 406 must be performed after step 404, it is possible that step 402 is performed after one or both of steps 404 and 406, so long as step 402 is performed before step 408. Additional steps may also be performed. For example, between steps 404 and 406, or as part of one of steps 404 and 406, fold or crease lines can be mechanically added to the blank before the blank is folded. Multiple instances of each of the steps described with reference to FIG. 4 can be performed simultaneously, or one after the other, before (or after) other steps described with reference to FIG. 4 are performed. For example, step 402 may be performed N times (simultaneously or successively) to produce N molded trays before any of the other steps are performed. For another examples, step 404 may be performed N times (simultaneously or successively) to produce N blanks before step 406 is performed. These are just a few examples, which are not intended to be all encompassing.

Beneficially, a plurality of the stackable packaging units (e.g., 102, 202 or 302) described herein can be shipped in a same shipping carton, with the units stacked above one another and likely also next to one another, and with items stored within the compartments (e.g., 114, 214 or 314) of the units, without any additionally protective packaging (e.g., molded pulp or other cushioning structures) being included in the shipping carton. After the shipping carton arrives at a store where the items are to be sold, the stackable packaging units (e.g., 102, 202 or 302) can be easily and quickly removed from the cartons using the handles (e.g., 142, 242 or 342), and can be placed directly on tables, shelves or other types of display platforms in stores. Where the molded trays of stackable packaging units include multiple compartments, each of which holds one or more items, or a single compartment holding multiple items, the stackable packaging units can be used to sell items in bundles or groups, and thus, the stackable packaging units can be used to sell bundle packs of items.

Beneficially, the covers (e.g., 132, 232 or 332) of the stackable packaging units (e.g., 102, 202 or 302) can help prevent the item(s) stored within the stackable packaging units from inadvertently falling out of the molded trays (e.g., 112, 212 or 312) if the stackable packaging units are tipped on their sides, or even turned upside down. More generally, the covers (e.g., 132, 232 or 332) can be designed such they prevent items from being removed from the stackable packaging units until the covers (e.g., 132, 232 or 332) are removed, or at least detached from the molded tray at one end.

Beneficially, where the covers (e.g., 132, 232 or 332) of the stackable packaging units (e.g., 102, 202 or 302) do not completely cover the compartments (e.g., 114, 214 or 314) of the molded trays (e.g., 112, 212 or 312), the items stored within the compartments will be at least partially visible to shoppers. Where desired, cutouts or openings can be included in the horizontal planar portion (e.g., 134, 234 or 334) of a cover and/or in the cover attachment arms (e.g., 136, 236 or 336) to make the compartments and items therein more visible. Such cutouts or openings, which can also be referred to as windows, may be smaller than the item(s) held within a stackable packaging unit (e.g., 102, 202 or 302) to prevent shoppers from removing, handling and potentially damaging (e.g., bruising) the items, making them less saleable. Alternatively, the openings or windows can be made larger than the item(s), to purposely allow people to remove item(s) from a stackable packaging unit (e.g., 102, 202 or 302) without needing to first remove or detach at least a portion of the cover (132, 232 or 332) from the molded tray (e.g., 112, 212 or 312). Beneficially, the handles (e.g., 142, 242 or 342) of the covers enable people that work in stores to stock tables, shelves or other types of display platforms in stores with the items stored in the stackable packaging units without the people needing to come in direct physical contact with the items. Further, the handles (e.g., 142, 242 or 342) of the covers enable shoppers to easily grasp the stackable packaging units to place them in their shopping cart or basket, and/or to easily carry the stackable packaging units to a checkout counter and out of a store, again, without needing to come into direct physical contact with the items stored in the units.

Beneficially, where the covers (e.g., 132, 232 or 332) are made from sheets of paperboard or cardboard, brand names, logos, images, ingredients, instructions, nutritional information, country of origin information, Price Look Up (PLU) codes, Universal Product Codes (UPCs), other types of barcodes and/or the like can be directly printed on the paperboard or cardboard before (and/or potentially after) the sheets of paperboard or cardboard are cut into blanks and folded into the covers that each include a handle, a horizontal planar portion, and two or more cover attachment arms. Additionally, or alternatively, labels including such text, codes, images, and/or the like, can be adhered to the paperboard or cardboard before (and/or potentially after) the sheets of paperboard or cardboard are cut into blanks and folded into the covers that each include a handle, a horizontal planar portion, and two or more cover attachment arms.

Beneficially the stackable packaging units described herein can be made partially or entirely of recycled materials. Additionally, or alternatively, the stackable packaging units described herein can beneficially themselves be recyclable and/or compostable.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Accordingly, the specification and drawings are to be regarded in an illustrative rather than a restrictive sense. It will, however, be evident that various modifications and changes may be made thereunto without departing from the broader spirit and scope of the present technology as set forth in the claims. For example, while various different molded trays (e.g., 112, 212 and 312) having various different numbers of compartments (e.g., four, six and one compartment(s)) have been shown and described, embodiments of the present technology also encompass stackable packaging units having molded trays with other numbers (e.g., three, five, eight, twelve, etc.) of compartments.

Other variations are also within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the present technology to the specific form or forms disclosed, but on the contrary, the intention is to cover all modifications, alternative constructions and equivalents falling within the spirit and scope of the present technology, as defined in the appended claims.

What is claimed is:

1. A stackable packaging unit, comprising:

a molded tray including one or more compartments and a female feature; and a cover attached to the molded tray and configured to cover at least a portion of at least one of the one or more compartments of the molded tray;

wherein the cover comprises folded paperboard or cardboard and includes a horizontal planar portion and a handle extending upward relative to the horizontal planar portion; and wherein the handle of the cover provides a male feature that is configured to fit within the female feature of a further instance of the stackable packaging unit that is stacked above the stackable packaging unit;

wherein the cover also includes two or more cover attachment arms that extend downward from the horizontal planar portion of the cover, the cover attachment arms for use in attaching the cover to the molded tray;

wherein a distal portion of each of two or more of the cover attachment arms includes one or more tabs that extend outward;

wherein the distal portion of each of the two or more of the cover attachment arms is inserted through a respective slot in the molded tray; and wherein the one or more tabs that extend outward from the distal portion of each of the two or more of the cover attachment arms prevents the cover attachment arm from being inadvertently detached from the molded tray.

2. The stackable packaging unit of claim 1, wherein the male feature provided by the handle, when fit within the female feature of a further instance of the stackable packaging unit that is stacked above the stackable packaging unit, inhibits the further instance of the stackable packaging unit from sliding horizontally to-and-fro and side-to-side relative to the cover upon which the further instance of the stackable packaging unit rests.

3. The stackable packaging unit of claim 2, wherein the male feature provided by the handle, when fit within the female feature of a further instance of the stackable packaging unit that is stacked above the stackable packaging unit, allows the further instance of the stackable packaging unit to be lifted up vertically relative to the cover upon which the further instance of the stackable packaging unit rests.

4. The stackable packaging unit of claim 1, wherein:

the female feature included in the molded tray includes one or more protrusions and/or indentations; and the male feature provided by the handle includes one or more indentations and/or protrusions that are configured that mate with respective protrusions and/or indentations within the female feature of a further instance of the stackable packaging unit that is stacked above the stackable packaging unit.

5. The stackable packaging unit of claim 1, wherein:

the molded tray also includes one or more support columns extending upward; and one or more regions of the horizontal planar portion of the cover are supported by the one or more support columns of the molded tray.

6. The stackable packaging unit of claim 5, wherein the one or more support columns of the molded tray are configured to prevent the horizontal planar portion of the cover from collapsing under the weight of a further instance of the stackable packaging unit that is stacked above the stackable packaging unit.

7. The stackable packaging unit of claim 1, wherein portions of the cover, including the horizontal planar portion, the handle, and the cover attachment arms, are made from a single sheet of the paperboard or cardboard that is cut and folded to provide said portions of the cover.

8. The stackable packaging unit of claim 1, wherein the molded tray is made of molded pulp.

9. The stackable packaging unit of claim 8, wherein the molded pulp from which the molded tray is made and the paperboard or cardboard that the cover comprises are both recyclable.

10. The stackable packaging unit of claim 8, wherein the molded pulp from which the molded tray is made and the paperboard or cardboard that the cover comprises both include postconsumer recycled material.

11. The stackable packaging unit of claim 1, wherein the horizontal planar portion of the cover provides a horizontal surface on which to rest the molded tray of a further instance of the stackable packaging unit that is stacked above the stackable packaging unit.

12. The stackable packaging unit of claim 1, wherein an entirety of the cover, including the horizontal planar portion, the handle, and the cover attachment arms, are made from a single sheet of the paperboard or cardboard that is cut and folded to provide said portions of the cover.

13. A stackable packaging unit, comprising:

a molded pulp tray including two or more compartments and a female feature located between two of the compartments;

a cover attached to the molded tray and including a horizontal planar portion, a handle extending upward therefrom, and two or more cover attachment arms, wherein portions of the cover, including the horizontal planar portion, the two or more cover attachment arms, and the handle, are made from a single sheet of the paperboard or cardboard that is cut and folded to provide said portions of the cover;

wherein the handle of the cover provides a male feature that is configured to fit within the female feature of a further instance of the stackable packaging unit that is stacked above the stackable packaging unit;

inhibit the further instance of the stackable packaging unit from sliding horizontally to-and-fro and side-to-side relative to the cover; and allow the further instance of the stackable packaging unit to be lifted up vertically relative to the cover;

wherein each cover attachment arm, of the two or more cover attachment arms of the cover, tapers downward from a proximal end of the cover attachment arm toward a distal end of the cover attachment arm;

wherein the proximal end of each of the two or more cover attachment arms is attached to and extends downward from the horizontal planar portion of the cover; and wherein each cover attachment arm, of the two or more cover attachment arms of the cover, is attached at the distal end of the cover attachment arm to the molded pulp tray thereby attaching the cover to the molded tray.

14. The stackable packaging unit of claim 13, wherein the cover is configured to allow products stored within the two or more compartments to be at least partially visible.

15. The stackable packaging unit of claim 13, wherein at least a portion of the horizontal planar portion of the cover is printed on or includes a label adhered thereto.

16. The stackable packaging unit of claim 13, wherein:

the distal portion, of at least one of the cover attachment arms, is inserted through a respective slot in the molded tray and includes one or more tabs that extend outward to prevent the cover attachment arm from being inadvertently detached from the molded tray.

17. The stackable packaging unit of claim 13, wherein:

the distal portion, of at least one of the cover attachment arms, is attached to the molded tray by an adhesive.

18. A stackable packaging unit, comprising:

a molded tray including one or more compartments, a female feature, and two or more slots; and a folded paperboard or cardboard cover element including a horizontal planar portion, two or more cover attachment arms that extend downward from the horizontal planar portion, and a handle that extends upward from the horizontal planar portion and provides a male feature that is configured to fit within the female feature of a further instance of the stackable packaging unit that is stacked above the stackable packaging unit;

wherein a distal portion of each of the cover attachment arms includes one or more tabs that extend outward;

the distal portion of each of the cover attachment arms, which includes the one or more tabs that extend outward, is inserted through a respective one of the slots in the molded tray and thereby attaches the cover attachment arms to the molded tray; and the one or more tabs that extend outward from the distal portion of each of the cover attachment arms prevents the cover attachment arms from being inadvertently detached from the molded tray.

19. The stackable packaging unit of claim 18, wherein potions of the cover element including the horizontal planar portion, the two or more cover attachment arms, and the one or more tabs that extend outward from each of the cover attachment arms, are made from a single sheet of paperboard or cardboard that is cut and folded to provide said portions of the cover element.

* * * * *